US010378493B2

(12) United States Patent
Hotta et al.

(10) Patent No.: US 10,378,493 B2
(45) Date of Patent: Aug. 13, 2019

(54) PIPING CONNECTION STRUCTURE

(71) Applicant: HONDA MOTOR CO., LTD., Tokyo (JP)

(72) Inventors: Kazuhito Hotta, Iruma-gun (JP); Takahiro Sano, Asaka (JP); Yasuhiro Matsui, Iruma-gun (JP)

(73) Assignee: HONDA MOTOR CO., LTD., Tokyo (JP)

( * ) Notice: Subject to any disclaimer, the term of this patent is extended or adjusted under 35 U.S.C. 154(b) by 432 days.

(21) Appl. No.: 15/131,098

(22) Filed: Apr. 18, 2016

(65) Prior Publication Data

US 2016/0348622 A1 Dec. 1, 2016

(30) Foreign Application Priority Data

May 29, 2015 (JP) ..... 2015-110664

(51) Int. Cl.
*F02M 37/00* (2006.01)
*F02M 55/02* (2006.01)
(Continued)

(52) U.S. Cl.
CPC ..... *F02M 37/0017* (2013.01); *F02D 9/109* (2013.01); *F02D 9/1035* (2013.01);
(Continued)

(58) Field of Classification Search
CPC ..... F02M 37/0017; F02M 69/465; F02M 69/462; F02M 35/162; F02M 35/116;
(Continued)

(56) References Cited

U.S. PATENT DOCUMENTS 783,987 A * 2/1905 Walsh ..... F16L 27/0849 123/189
1,475,867 A * 11/1923 Peterson ..... F16L 23/12 285/184
(Continued)

FOREIGN PATENT DOCUMENTS

JP 2001107820 A * 4/2001
JP A-2001-107820 4/2001
(Continued)

OTHER PUBLICATIONS

Published 2009; "Commonality and its Measurement in Manufacturing Resources Planning". Journal of Applied Sciences, 9: 69-78., retrieved from the internet Apr. 26, 2018; https://scialert.net/fulltext/?doi=jas.2009.69.78.*
(Continued)

*Primary Examiner* — Sizo B Vilakazi
*Assistant Examiner* — Brian R Kirby
(74) *Attorney, Agent, or Firm* — Drinker Biddle & Reath LLP

(57) ABSTRACT

In a piping connection structure of a vehicle including: a throttle body connected to a power unit of the vehicle to adjust an intake air amount; a fuel injection device for injecting fuel to an intake passage including the throttle body; first pipings attached to the fuel injection device; and second pipings provided separately from the first pipings, and having end parts connected to the first pipings so as to intersect with the first pipings, a connection part between the first pipings and the second pipings has a long adjustment holes, which extend so as to allow adjustment of relative angles between the first pipings and the second pipings.

4 Claims, 12 Drawing Sheets

(51) Int. Cl.

| | |
|---|---|
| ***F02M 35/10*** | (2006.01) |
| ***F02M 35/16*** | (2006.01) |
| ***F02D 9/10*** | (2006.01) |
| ***F02M 69/46*** | (2006.01) |
| ***F02M 35/116*** | (2006.01) |
| *F02M 69/04* | (2006.01) |

(52) U.S. Cl.
CPC ..... *F02M 35/10* (2013.01); *F02M 35/10216* (2013.01); *F02M 35/10373* (2013.01); *F02M 35/116* (2013.01); *F02M 35/162* (2013.01); *F02M 55/02* (2013.01); *F02M 69/462* (2013.01); *F02M 69/465* (2013.01); *F02M 69/043* (2013.01)

(58) Field of Classification Search
CPC ..... F02M 35/10373; F02M 35/10216; F02M 69/043; F02M 37/0047; F02D 9/109; F02D 9/1035; F16L 27/053; F16L 33/28; F16L 41/086; F16L 37/124; F16L 19/025; F16L 19/0286
USPC ..... 123/456, 468, 470, 469, 447, 445
See application file for complete search history.

(56) References Cited

U.S. PATENT DOCUMENTS 1,903,029 A * 3/1933 Damsel ..... F16L 21/06 138/99
2,839,040 A * 6/1958 High ..... F02M 69/00 123/382
2,920,608 A * 1/1960 Orban ..... F22B 1/16 122/20 B
3,454,767 A * 7/1969 Stevens ..... F23N 5/08 250/372
3,557,564 A * 1/1971 Hauber ..... E21B 43/0107 166/358
4,621,839 A * 11/1986 Duell ..... F16L 5/00 285/136.1
4,738,276 A * 4/1988 Adams ..... F16K 11/20 137/343
5,002,030 A * 3/1991 Mahnke ..... F02M 55/004 123/456
5,022,372 A * 6/1991 Imura ..... F02M 69/465 123/456
5,513,613 A * 5/1996 Taylor ..... F02M 51/005 123/456
5,598,824 A * 2/1997 Treusch ..... F02M 51/005 123/456
5,813,706 A * 9/1998 Travis ..... F16L 23/032 285/184
5,912,936 A * 6/1999 Charnley ..... F16L 27/053 376/282
6,006,773 A * 12/1999 Bravo ..... B67D 7/78 137/15.08
6,050,614 A * 4/2000 Kirkpatrick ..... F16L 23/024 123/469
6,331,020 B1 * 12/2001 Brunella ..... F16L 23/032 285/179
6,460,511 B2 * 10/2002 Kato ..... F02B 61/045 123/468
6,672,287 B2 * 1/2004 Wada ..... F02B 61/045 123/456
6,827,064 B2 * 12/2004 Akagi ..... F02B 61/02 123/431
6,843,219 B2 * 1/2005 Matsuda ..... F02M 35/10032 123/184.21
6,912,996 B2 * 7/2005 Kato ..... F02B 61/045 123/456
7,013,874 B2 * 3/2006 Kurayoshi ..... F02B 61/02 123/468
7,066,135 B2 * 6/2006 Ishikawa ..... F02M 35/10039 123/198 E
7,168,517 B2 * 1/2007 Udono ..... F02B 23/08 123/399
7,556,021 B2 * 7/2009 Toriumi ..... F02M 35/10032 123/337
7,647,917 B2 * 1/2010 Matsuda ..... F02M 69/465 123/447
8,047,180 B2 * 11/2011 Sato ..... F02D 9/1095 123/336
8,499,745 B2 * 8/2013 Ishiki ..... F02M 55/02 123/456
9,062,645 B2 * 6/2015 Uchiyama ..... B62J 37/00
9,464,604 B2 * 10/2016 Koyama ..... F02M 35/10
2003/0070658 A1 * 4/2003 Warner ..... F02M 51/005 123/456
2004/0089266 A1 * 5/2004 Kawai ..... F02D 9/1035 123/399
2005/0051138 A1 * 3/2005 Haley ..... F02M 35/10026 123/468
2006/0042601 A1 * 3/2006 Hotta ..... F02B 31/04 123/468
2008/0129048 A1 * 6/2008 Nagle ..... F16L 17/04 285/412
2011/0108003 A1 * 5/2011 Kimura ..... F02M 35/10216 123/456
2013/0140809 A1 * 6/2013 Svensson ..... F16L 19/005 285/91
2013/0186370 A1 * 7/2013 Uchiyama ..... F02M 63/0275 123/445
2014/0182556 A1 * 7/2014 Nishimura ..... F02M 35/10242 123/470
2015/0007786 A1 * 1/2015 Kawata ..... F02M 69/043 123/52.1
2015/0007794 A1 * 1/2015 Kawata ..... F02M 69/042 123/445
2015/0246702 A1 * 9/2015 Tani ..... B62J 37/00 180/219

FOREIGN PATENT DOCUMENTS

| | | |
|---|---|---|
| JP | A-2002-317738 | 10/2002 |
| JP | 2002-339836 A | 11/2002 |
| JP | A-2011-214514 | 10/2011 |
| JP | A-2013-148071 | 8/2013 |
| JP | A-2015-014212 | 1/2015 |

OTHER PUBLICATIONS

"NPL_Smaltmoto_Shower_Injection_Kit_Published_04_01_2012"; Published Apr. 1, 2012. See pp. 4-6. NPL retreived from the internet Mar. 27, 2019; https://www.apriliaforum.com/forums/showthread.php?195092-Gear-to-read-amp-burn-Eprom-chips-Shower-Injection-amp-more (Year: 2012).*
JP Office Action dated Aug. 15, 2017 from corresponding Japanese patent application No. 2015-110664 (with attached English-language translation).

* cited by examiner

PIPING CONNECTION STRUCTURE

CROSS-REFERENCE TO RELATED APPLICATION

Priority is claimed on Japanese Patent Application No. 2015-110664, filed on May 29, 2015, the contents of which are incorporated herein by reference.

BACKGROUND OF THE INVENTION

Field of the Invention

The present invention relates to a piping connection structure.

Description of Related Art

Conventionally, there has been a piping connection structure disclosed in Japanese Patent Application Publication No. 2002-339836, for example. Here, a fuel rail attached to multiple fuel injection valves of an engine, and a fuel conduit provided separately from the fuel rail, and having an end part connected to the fuel rail so as to intersect with the fuel rail are joined with a collar, and then the collar is fastened and fixed with a bolt.

SUMMARY OF THE INVENTION

However, if the height of the fuel injection valve is set for each model, the length of the fuel conduit needs to be set for each model. For this reason, there has been a need to improve versatility of the fuel conduit.

Hence, the present invention aims to improve versatility of piping, in a piping connection structure of a vehicle including: first piping attached to a fuel injection device; and second piping provided separately from the first piping, and having an end part connected to the first piping so as to intersect with the first piping.

As means for solving the above problem, an invention described in claim 1 is a piping connection structure of a vehicle (1) including: a throttle body (30) connected to a power unit (10) of the vehicle (1) to adjust an intake air amount; a fuel injection device (50) for injecting fuel to an intake passage including the throttle body (30); first piping (61, 63) attached to the fuel injection device (50); and second piping (62, 64) provided separately from the first piping (61, 63), and having an end part connected to the first piping (61, 63) so as to intersect with the first piping (61, 63), characterized in that a connection part (70) between the first piping (61, 63) and the second piping (62, 64) has a long adjustment hole (70*h*), which extends so as to allow adjustment of a relative angle between the first piping (61, 63) and the second piping (62, 64).

An invention described in claim 2 is characterized in that: the connection part (70) includes a flow path forming portion (73) forming a flow path that guides fuel from the second piping (62, 64) to the first piping (61, 63), a first connection part (74) provided on one side of the flow path forming portion (73), and a second connection part (75) provided on the other side of the flow path forming portion (73) opposite to the first connection part (74); and the adjustment hole (70*h*) includes a first adjustment hole (74*h*) formed in the first connection part (74), and a second adjustment hole (75*h*) formed in the second connection part (75).

An invention described in claim 3 is characterized in that: the fuel injection device (50) includes a first injector (51, 53) and a second injector (52, 54); the first injector (51, 53) and the second injector (52, 54) are arranged side by side in the vehicle width direction; the first piping (61, 63) extends in the vehicle width direction, so as to straddle the first injector (51, 53) and the second injector (52, 54); and the adjustment hole (70*h*) is formed into an arc shape, along the outer periphery of the first piping (61, 63) in side view.

An invention described in claim 4 is characterized in that: a supporting member (77, 78) supporting the first piping (61, 63) is provided in the throttle body (30); and a spacer (79) is provided between the first piping (61, 63) and the supporting member (77, 78).

An invention described in claim 5 is characterized in that: the first piping (61, 63) includes upstream first piping (61*a*, 63*a*) connected to the upstream side of the second piping (62, 64), and downstream first piping (61*b*, 63*b*) connected to the downstream side of the second piping (62, 64); the connection part (70) includes an upstream connection part (71*a*, 72*a*) connecting the upstream first piping (61*a*, 63*a*) and the upstream side of the second piping (62, 64), and a downstream connection part (71*b*, 72*b*) connecting the downstream first piping (61*b*, 63*b*) and the downstream side of the second piping (62, 64); and the adjustment hole (70*h*) is formed in both of the upstream connection part (71*a*, 72*a*) and the downstream connection part (71*b*, 72*b*).

An invention described in claim 6 is characterized in that: the fuel injection device (50) includes a first injector (51, 53) and a second injector (52, 54); the first injector (51, 53) and the second injector (52, 54) each includes an upstream injector (51*a*, 52*a*, 53*a*, 54*a*) and a downstream injector (51*b*, 52*b*, 53*b*, 54*b*); the upstream injector (51*a*, 52*a*, 53*a*, 54*a*) is provided in the upstream first piping (61*a*, 63*a*); and the downstream injector (51*b*, 52*b*, 53*b*, 54*b*) is provided in the downstream first piping (61*b*, 63*b*).

According to the invention described in claim 1, the connection part between the first piping and the second piping has the long adjustment hole, which extends so as to allow adjustment of the relative angle between the first piping and the second piping. Hence, by rotating the connection part along the long hole shape of the adjustment hole, the relative angle (angle at which the second piping is attached to the first piping) can be adjusted with the second piping having substantially the same looseness. For this reason, a common second piping can be set, even when the height of the fuel injection device is set for each model. Accordingly, versatility of the second piping can be improved. Additionally, since versatility of the second piping is improved, cost can be reduced by mass production.

According to the invention described in claim 2, the adjustment hole includes the first adjustment hole formed in the first connection part, and the second adjustment hole formed in the second connection part. Since the first adjustment hole and the second adjustment hole are provided so as to sandwich the flow path forming portion, the second piping can be attached more stably to the first piping, as compared to a case where only a single adjustment hole is provided. Additionally, fine adjustment of the relative angle is facilitated.

According to the invention described in claim 3, the adjustment hole is formed into an arc shape, along the outer periphery of the first piping in side view. Since the relative angle can be adjusted with the first piping and the second piping joined temporarily, it is easier to attach the second piping to the first piping and work time can be reduced, as compared to a case where multiple round holes are arranged at predetermined intervals, along the outer periphery of the first piping in side view. Additionally, fine adjustment of the relative angle is facilitated.

According to the invention described in claim 4, the spacer is provided between the first piping and the supporting member. Hence, the height of the first piping can be adjusted by adjusting the height of the spacer. Therefore, a common first piping can be set, even when the capacity of the fuel injection device is varied. Accordingly, versatility of the first piping can be improved. Additionally, since versatility of the first piping is improved, cost can be reduced by mass production.

According to the invention described in claim 5, the adjustment hole is formed in both of the upstream connection part and the downstream connection part. Hence, the second piping can be used by inverting the upstream and downstream sides thereof. Accordingly, versatility of the second piping can be improved. Additionally, since versatility of the second piping is improved, cost can be reduced by mass production.

According to the invention described in claim 6, the upstream injector is provided in the upstream first piping, while the downstream injector is provided in the downstream first piping. Hence, a common first piping can be used even when the upstream injector and the downstream injector are varied, and versatility of the second piping can be improved. Therefore, cost can be reduced by mass production.

DESCRIPTION OF EMBODIMENTS

Figure 1:
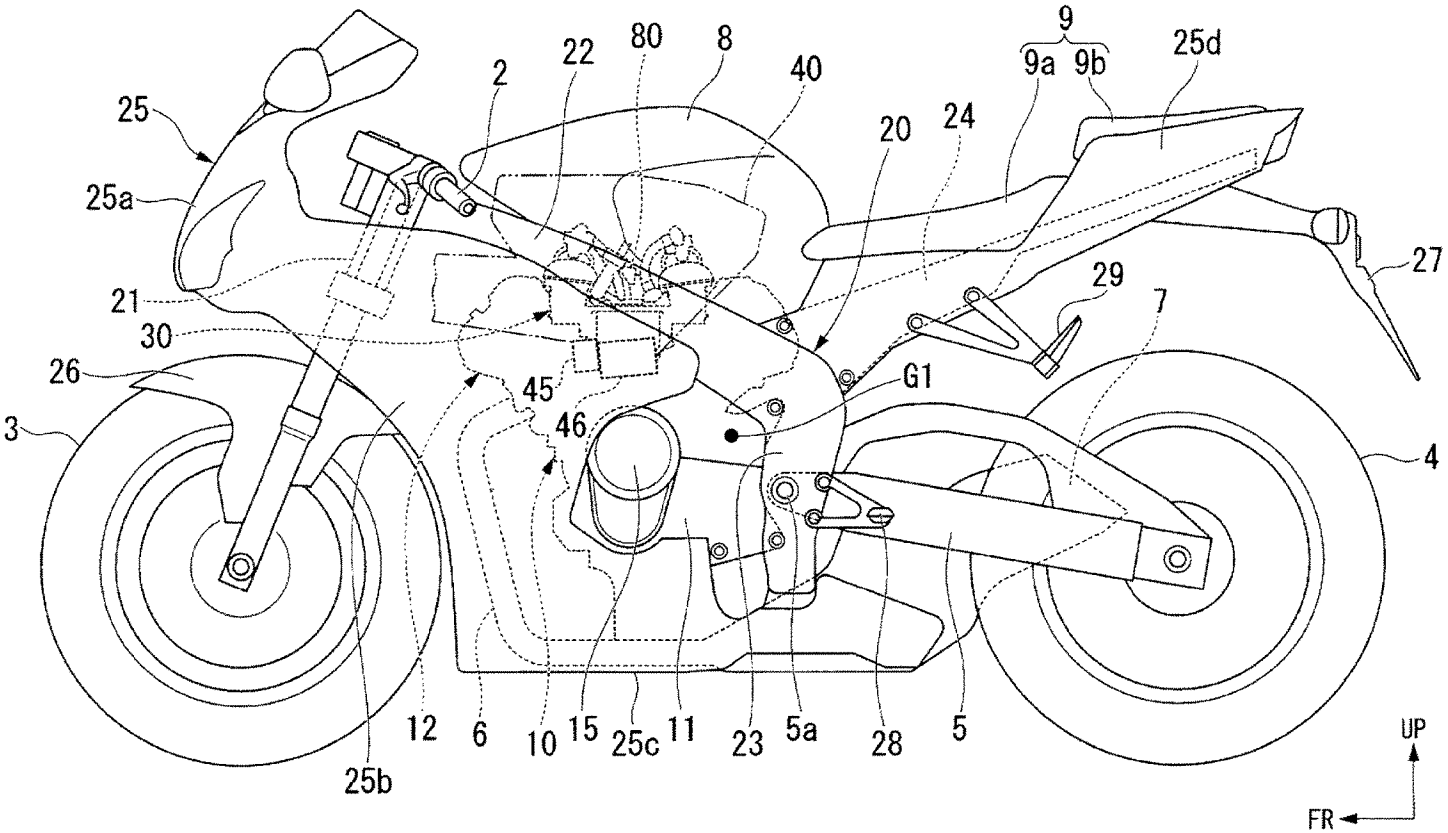
FIG. 1 is a left side view of a motorcycle of an embodiment of the present invention.

Hereinafter, an embodiment of the present invention will be described with reference to the drawings. Note that in the following description, directions such as front and rear, left and right are the same as directions of a vehicle described below, if not stated otherwise. Also, an arrow FR indicating the front of the vehicle, an arrow LH indicating the left of the vehicle, an arrow UP indicating the upper direction of the vehicle, and a vehicle left-right centerline CL are shown in appropriate parts in the drawings used in the following description.

<Entire Vehicle>

FIG. 1 shows a motorcycle 1 as an example of a straddle type vehicle. Referring to FIG. 1, the motorcycle 1 includes a bar handle 2, a front wheel 3 steered by the bar handle 2, and a rear wheel 4 driven by a power unit 10 including a V4 engine. The motorcycle is sometimes referred to simply as "vehicle" below.

Steering system parts including the bar handle 2 and the front wheel 3 are steerably and pivotally supported, to a head pipe 21 at the front end of a body frame 20. The power unit 10 is arranged in a longitudinal center part of the body frame 20. Paired left and right swing arms 5 are pivotally supported to a rear part of the power unit 10, so as to be vertically swingable around a pivot shaft 5*a*. An unillustrated rear suspension is interposed between front parts of the left and right swing arms 5 and a rear part of the body frame 20.

For example, the body frame 20 is formed by joining multiple kinds of steel materials into one body, by welding or other methods. The body frame 20 includes the head pipe 21, paired left and right main frames 22 extending in the rear lower direction from the head pipe 21, paired left and right pivot plates 23 connected to rear end parts of the paired left and right main frames 22 and extending downward, and paired left and right seat frames 24 connected to upper parts of the paired left and right pivot plates 23 and extending in the rear upper direction.

The power unit 10 is attached to the paired left and right pivot plates 23 and an unillustrated engine hanger. The power unit 10 includes a crankcase 11, a cylinder portion 12 arranged in an upper part of the crankcase 11 and formed into a V shape in side view, a generator cover 15 attached to a left side face of the crankcase 11, and an unillustrated clutch cover attached to a right side face of the crankcase 11.

A throttle body 30, which is connected to the cylinder portion 12 and configured to adjust the intake air amount, is provided above the power unit 10. An air cleaner box 40 for cleaning intake air of the throttle body 30 is provided, between the paired left and right main frames 22 in the vehicle width direction. A gyro sensor 80 is arranged inside the air cleaner box 40.

An exhaust pipe 6 is connected to the cylinder portion 12. The exhaust pipe 6 extends below the power unit 10, is arranged on the right side of the rear wheel 4, and is connected to a muffler 7 extending obliquely upward in the rear direction. A fuel tank 8 is arranged above the cylinder portion 12 and between the paired left and right main frames 22. A seat 9 is arranged behind the fuel tank 8 and on the paired left and right seat frames 24. The seat 9 includes a front seat 9*a* for the rider, and a rear seat 9*b* for the passenger.

A body cover 25 covers the body frame 20. The body cover 25 includes a front cowl 25*a* covering a front part of the body frame 20, a front side cowl 25*b* covering sides of a front part of the body frame 20, an under cowl 25*c* covering a lower part of the body frame 20, and a rear cowl 25*d* covering a rear part of the body frame 20.

A battery 45 and a power delivery unit (PDU) 46, which are rectangular in side view, are provided on the inner side in the vehicle width direction of the front side cowl 25*b*. The battery 45 and the power delivery unit 46 are attached to a left end part of the left main frame 22, through an unillustrated bracket. The battery 45 and the power delivery unit 46 are arranged adjacent to each other at the front and rear.

Therefore, since the power delivery unit 46 is arranged closer to the battery 45, generation of unwanted resistance can be suppressed, and the current can be split effectively by the power delivery unit 46, as compared to a case where the battery 45 and the power delivery unit 46 are arranged away from each other. The current split by the power delivery unit 46 is supplied to the electric parts in appropriate current values.

Note that in FIG. 1, reference numeral 26 indicates a front fender, reference numeral 27 indicates a rear fender, reference numeral 28 indicates a main step on which the rider places his/her foot, reference numeral 29 indicates a pillion step on which the passenger places his/her foot, and reference numeral G1 indicates the position of the center of gravity of the vehicle 1.

Figure 2:
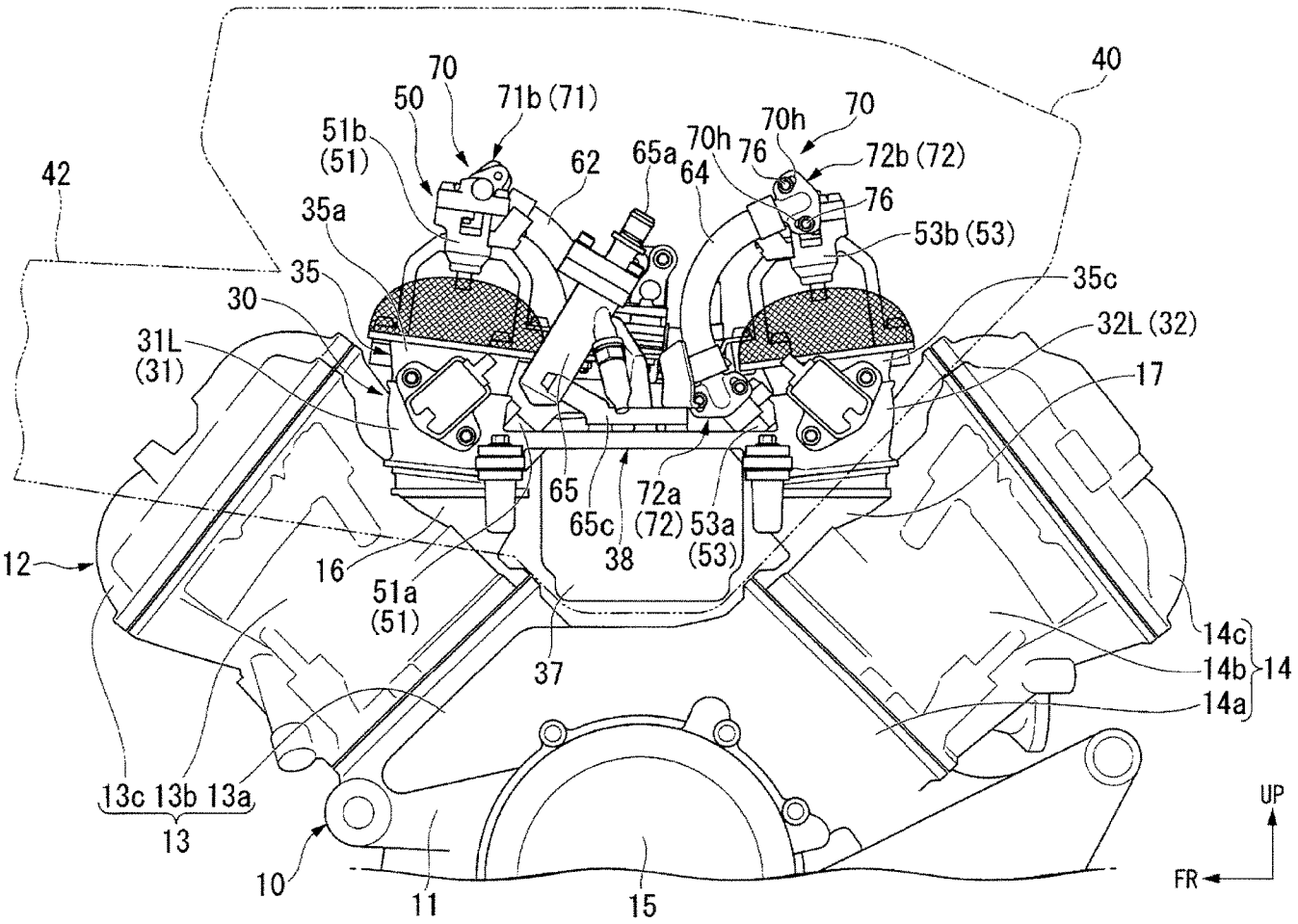
FIG. 2 is a left side view in which a main part of the aforementioned motorcycle is enlarged.

Also referring to FIG. 2, the cylinder portion 12 includes a front cylinder 13 and a rear cylinder 14, which are arranged at the front and rear with a gap in between. The front cylinder 13 protrudes toward the front upper direction from an upper part of the crankcase 11, while the rear cylinder 14 protrudes toward the rear upper direction from an upper part of the crankcase 11.

The front cylinder 13 includes a front cylinder block 13*a* formed integrally with a front upper part of the crankcase 11, a front cylinder head 13*b* attached to an upper end part of the front cylinder block 13*a*, and a front cylinder head cover 13*c* attached to an upper end part of the front cylinder head 13*b*.

The rear cylinder 14 includes a rear cylinder block 14*a* formed integrally with a rear upper part of the crankcase 11, a rear cylinder head 14*b* attached to an upper end part of the rear cylinder block 14*a*, and a rear cylinder head cover 14*c* attached to an upper end part of the rear cylinder head 14*b*.

A front intake port 16 is formed in a rear face of the front cylinder head 13*b*, while a rear intake port 17 is formed in a front face of the rear cylinder head 14*b*.

The air cleaner box 40 is arranged between the rear face of the front cylinder head 13*b* and the front face of the rear cylinder head 14*b*, so as to surround the throttle body 30 and other parts.

<Air Cleaner Box>

Figure 3:
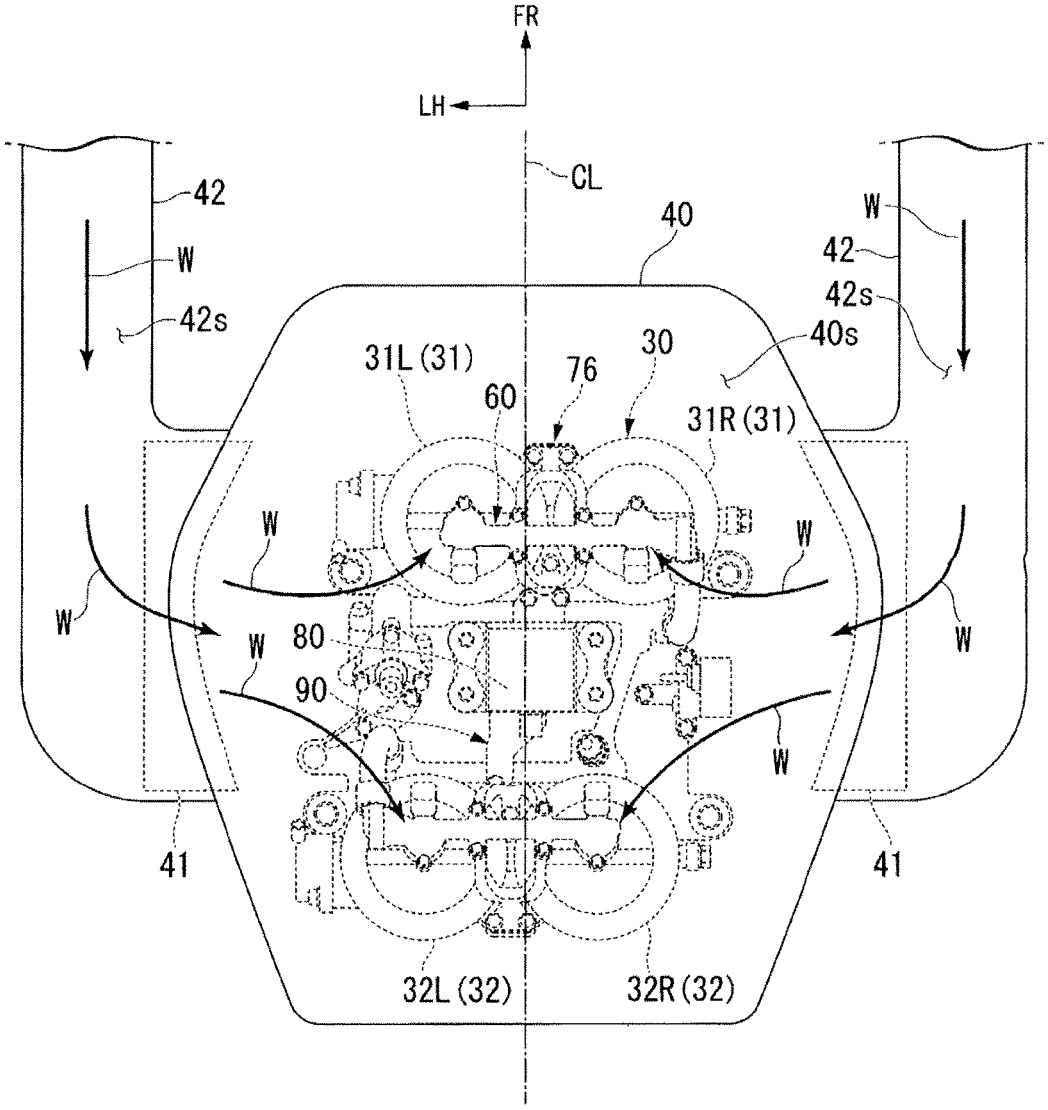
FIG. 3 is a top view of an air cleaner box of the aforementioned motorcycle.

Also referring to FIG. 3, the air cleaner box 40 is formed into a hexagonal box shape having rounded corners in top view. Intake ducts 42 are connected to left and right sides of the air cleaner box 40. The left and right intake ducts 42 extend longitudinally along the vehicle left-right centerline CL in top view, curve inward in the vehicle width direction on the rear end sides, and reach the left and right sides of the air cleaner box 40.

Air cleaner elements 41 are provided inside inner end parts in the vehicle width direction of the left and right intake ducts 42, on left and right side faces of the air cleaner box 40 (connection parts between the air cleaner box 40 and the left and right intake ducts 42). The left and right air cleaner elements 41 separate dirty sides 42*s* inside the left and right intake ducts 42 and a clean side 40*s* inside the air cleaner box 40. The dirty side 42*s* is positioned on the upstream side of the air cleaner element 41, and the clean side 40*s* is positioned on the downstream side of the air cleaner element 41. The gyro sensor 80 is arranged on the clean side 40*s*.

Outside air introduced into the dirty sides 42*s* inside the left and right intake ducts 42 pass through the air cleaner elements 41 from outer to inner sides in the vehicle width direction thereof, is filtered and reaches the clean side 40*s*, and thereafter passes through the throttle body 30 and other parts, to be sucked into the cylinder portion 12. Note that arrows W in FIG. 3 indicate the flow of intake air.

<Throttle Body>

Referring to FIG. 2, the throttle body 30 includes a front throttle body 31 connected to the front intake port 16, and a rear throttle body 32 connected to the rear intake port 17. The throttle body 30 adjusts the intake air amount by the front and rear throttle bodies 31, 32.

Figure 4:
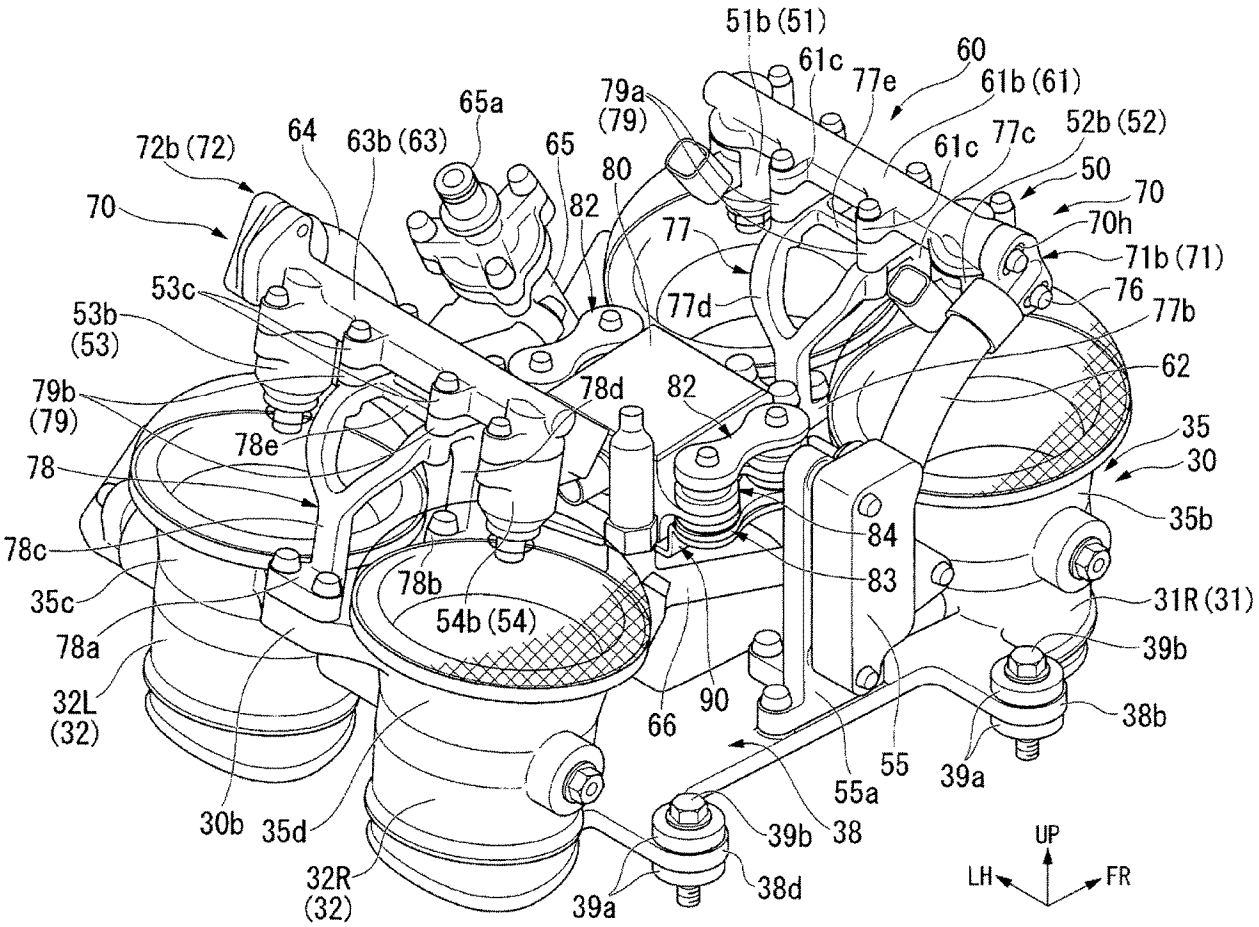
FIG. 4 is a perspective view of a piping connection structure of the aforementioned motorcycle, as seen from the rear upper right direction.
Figure 5:
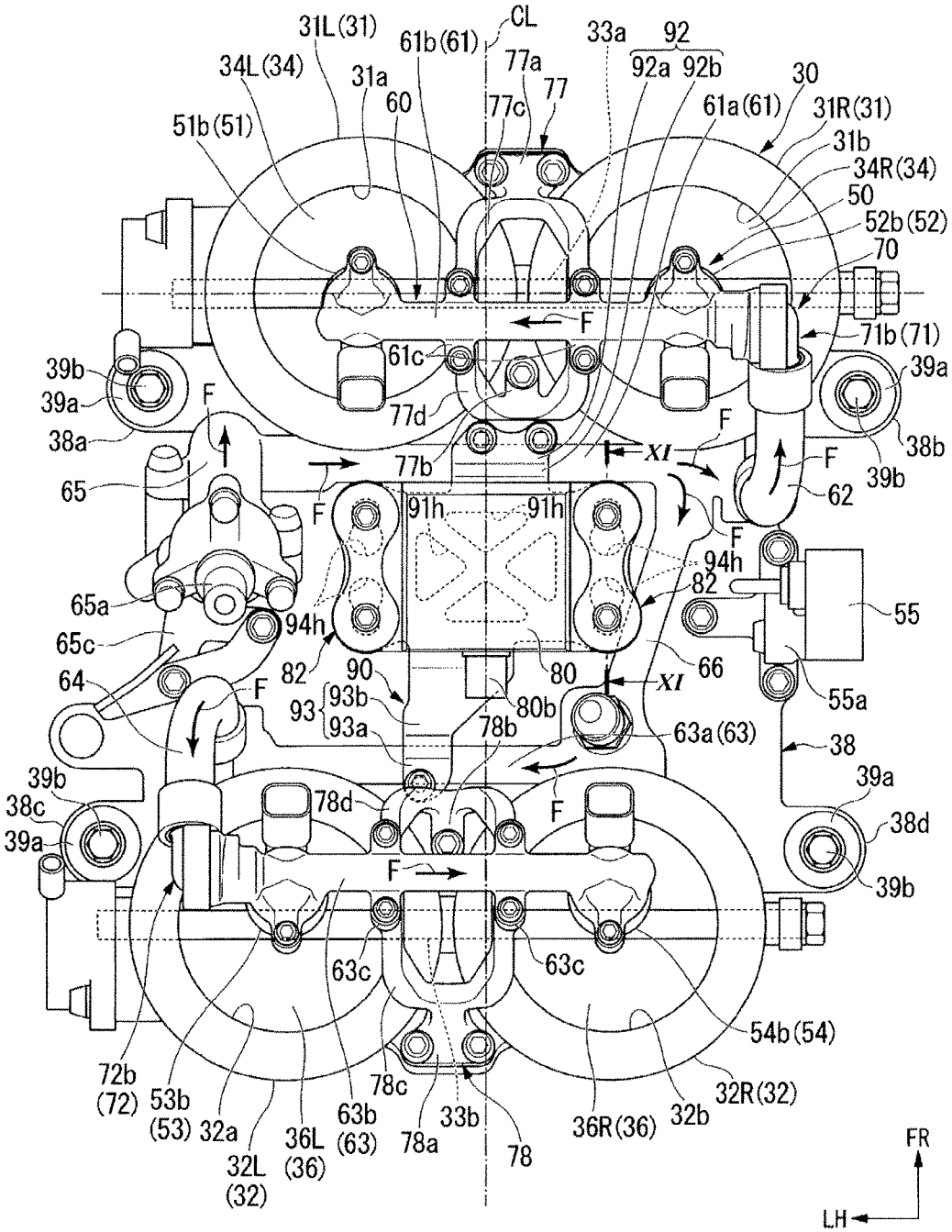
FIG. 5 is a top view of the aforementioned piping connection structure.

Also referring to FIGS. 4 and 5, the front throttle body 31 includes a left front throttle body 31L connected to a cylinder on the left front side of the engine, and a right front throttle body 31R connected to a cylinder on the right front side of the engine. A front valve shaft 33*a* extending along the vehicle width direction is rotatably supported, to the left front throttle body 31L and the right front throttle body 31R. A front throttle valve 34 is attached to the front valve shaft 33*a*. The front throttle valve 34 includes a left front throttle valve 34L for opening and closing an intake passage 31*a* inside the left front throttle body 31L, and a right front throttle valve 34R for opening and closing an intake passage 31*b* inside the right front throttle body 31R.

The rear throttle body 32 includes a left rear throttle body 32L connected to a cylinder on the left rear side of the engine, and a right rear throttle body 32R connected to a cylinder on the right rear side of the engine. A rear valve shaft 33*b* extending along the vehicle width direction is rotatably supported, to the left rear throttle body 32L and the right rear throttle body 32R. A rear throttle valve 36 is attached to the rear valve shaft 33*b*. The rear throttle valve 36 includes a left rear throttle valve 36L for opening and closing an intake passage 32*a* inside the left rear throttle body 32L, and a right rear throttle valve 36R for opening and closing an intake passage 32*b* inside the right rear throttle body 32R.

The front and rear throttle valves 34, 36 are driven by a valve driving device 37 (see FIG. 2), through an unillustrated link.

<Intake Part>

Figure 6:
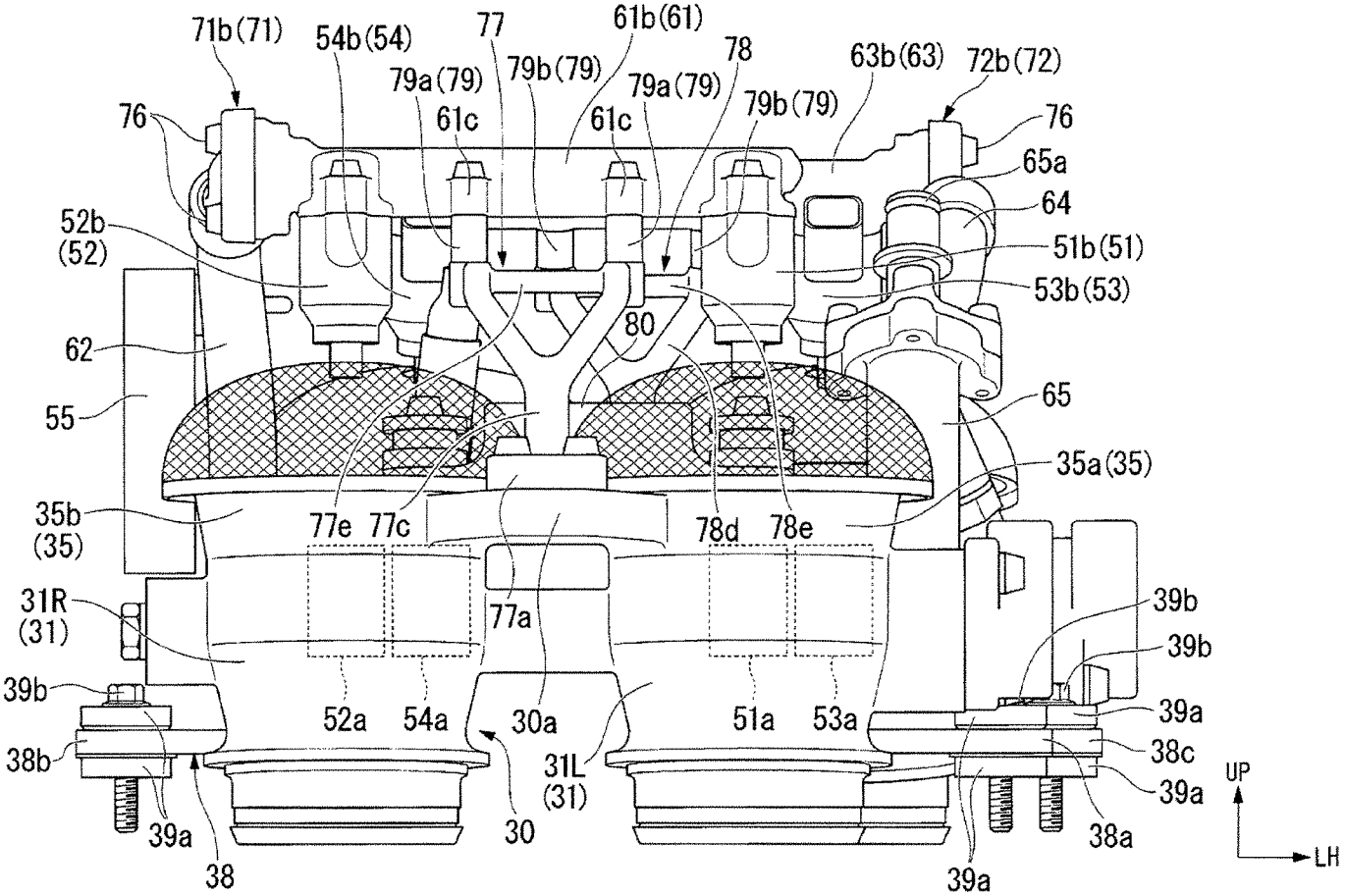
FIG. 6 is a front view of the aforementioned piping connection structure.

Also referring to FIG. 6, an intake part 35 is provided in an upper part of the throttle body 30. The intake part 35 includes a left front air funnel 35*a* in an upper part of the left front throttle body 31L, a right front air funnel 35*b* in an upper part of the right front throttle body 31R, a left rear air funnel 35*c* in an upper part of the left rear throttle body 32L, and a right rear air funnel 35*d* in an upper part of the right rear throttle body 32R. The gyro sensor 80 is arranged near the intake part 35. To be specific, the gyro sensor 80 is arranged in a space surrounded by the left front air funnel 35*a*, the right front air funnel 35*b*, the left rear air funnel 35*c*, and the right rear air funnel 35*d*.

A front connection portion 30*a* connecting the left front air funnel 35*a* and the right front air funnel 35*b* is formed, in an upper part of the front throttle body 31. The front connection portion 30*a* extends in the vehicle width direction so as to bridge the left front air funnel 35*a* and the right front air funnel 35*b*, and protrudes frontward so as to form a protrusion.

A rear connection portion 30*b* connecting the left rear air funnel 35*c* and the right rear air funnel 35*d* is formed, in an upper part of the rear throttle body 32. The rear connection portion 30*b* extends in the vehicle width direction so as to bridge the left rear air funnel 35*c* and the right rear air funnel 35*d*, and protrudes rearward so as to form a protrusion.

<Connection Plate>

A connection plate 38 connecting the front and rear throttle bodies 31, 32 is provided, between the front and rear throttle bodies 31, 32 provided at the front and rear. The connection plate 38 is formed into a plate, which is thick in the vertical direction. Protrusions 38*a* to 38*d*, which protrude outward in the vehicle width direction, are formed in front and rear end parts of the connection plate 38. A through hole (not shown) opened in the vertical direction is formed in each of the protrusions 38*a* to 38*d*. The connection plate 38 is fixed to the paired left and right main frames 22 (see FIG. 1), through brackets (not shown). For example, the connection plate 38 is fastened and fixed, by inserting bolts 39*b* into the through holes while clamping upper and lower faces of each of the protrusions 38*a* to 38*d* with a collar 39*a* or other parts, and screwing the bolts 39*b* into nuts (none are shown) provided in the brackets. Note that the connection plate 38 may be fixed by welding, for example.

A fuel injection device 50 for injecting fuel to the intake passage inside the throttle body 30, auxiliary machinery 55 of electric parts and other parts, and piping 60 attached to the fuel injection device 50, are provided above the connection plate 38.

Note that the fuel injection device 50 may be provided so as to inject fuel to an intake passage outside the throttle body 30. That is, it suffices that the fuel injection device 50 be provided so as to inject fuel, to an intake passage including the throttle body 30.

<Fuel Injection Device>

The fuel injection device 50 includes a left front injector 51 for injecting fuel to the intake passage 31*a* inside the left front throttle body 31L, a right front injector 52 for injecting fuel to the intake passage 31*b* inside the right front throttle body 31R, a left rear injector 53 for injecting fuel to the intake passage 32*a* inside the left rear throttle body 32L, and a right rear injector 54 for injecting fuel to the intake passage 32*b* inside the right rear throttle body 32R. The left front injector 51 and the right front injector 52 are arranged side by side in the vehicle width direction. The left rear injector 53 and the right rear injector 54 are arranged side by side in the vehicle width direction behind the left front injector 51 and the right front injector 52, with the gyro sensor 80 in between.

Here, the left front injector and the left rear injector correspond to "first injector" in the scope of claims, while the right front injector and the right rear injector correspond to "second injector" in the scope of claims. Note that the injectors 51, 53 and the injectors 52, 54 may each be arranged side by side in the direction that intersects with the vehicle width direction. That is, it suffices that each of the injectors 51, 52 and the injectors 53, 54 are arranged side by side in one direction.

Figure 7:
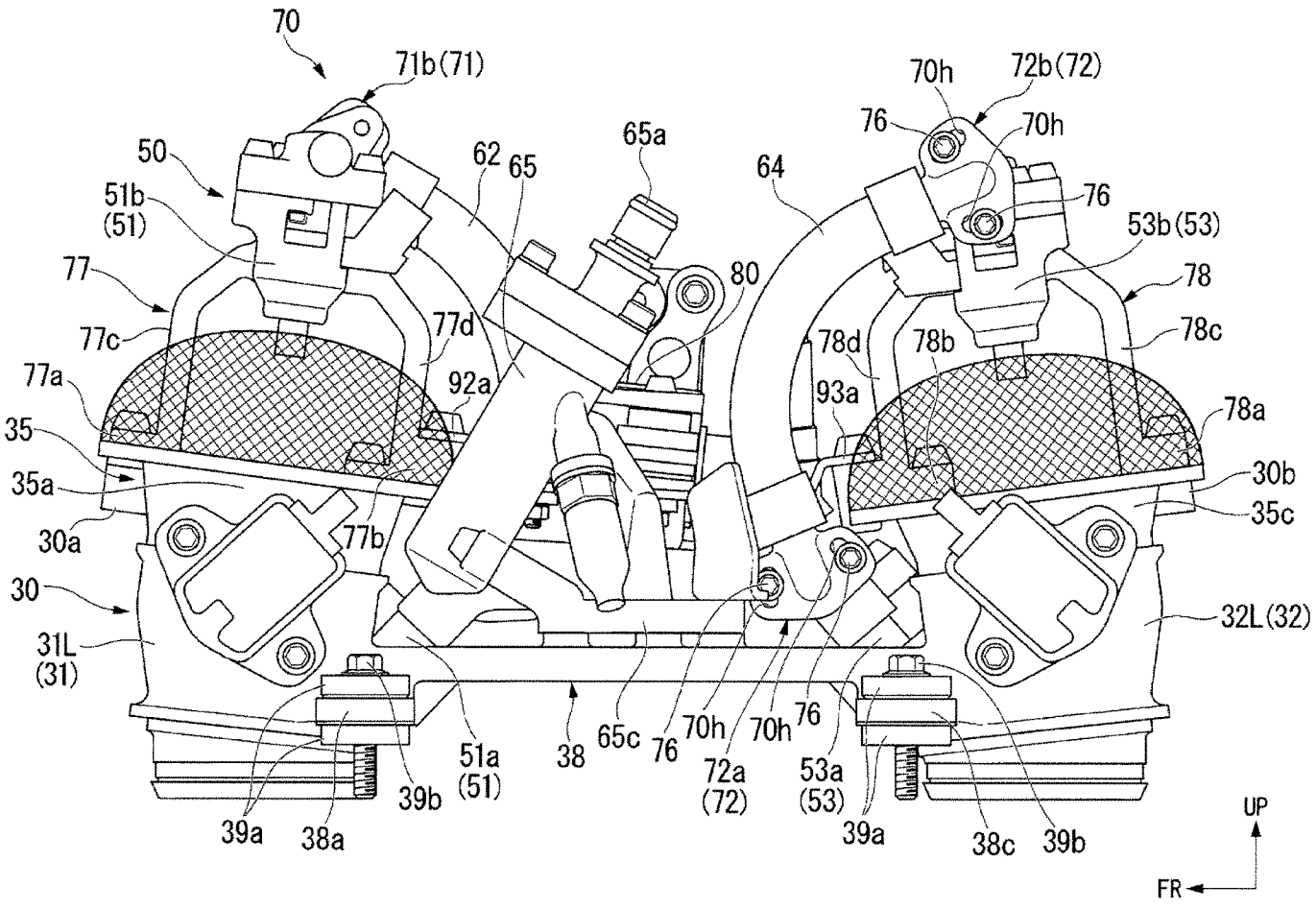
FIG. 7 is a left side view of the aforementioned piping connection structure.
Figure 8:
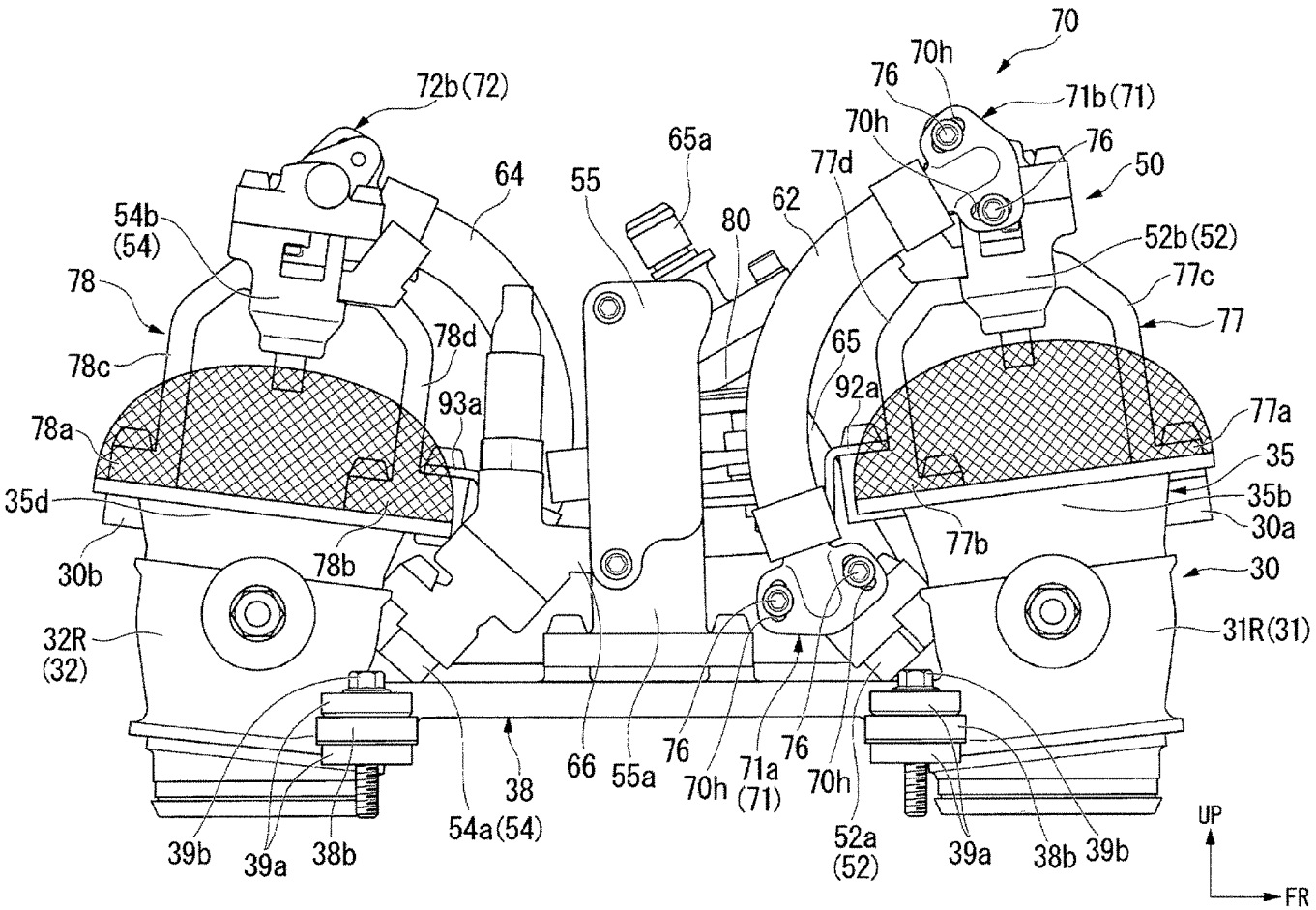
FIG. 8 is a right side view of the aforementioned piping connection structure.

Also referring to FIGS. 7 and 8, the left front injector 51 includes: an upstream left front injector 51*a*, which is arranged on the lower side of the left front throttle body 31L (specifically, on a lower rear face of the left front throttle body 31L), and positioned on the upstream side of the flow of fuel; and a downstream left front injector 51*b*, which is arranged on the upper side of the left front throttle body 31L (specifically, a position facing the left front air funnel 35*a*), and positioned on the downstream side of the flow of fuel.

The right front injector 52 includes: an upstream right front injector 52*a*, which is arranged on the lower side of the right front throttle body 31R (specifically, on a lower rear face of the right front throttle body 31R), and positioned on the upstream side of the flow of fuel; and a downstream right front injector 52*b*, which is arranged on the upper side of the right front throttle body 31R (specifically, a position facing the right front air funnel 35*b*), and positioned on the downstream side of the flow of fuel.

The left rear injector 53 includes: an upstream left rear injector 53*a*, which is arranged on the lower side of the left rear throttle body 32L (specifically, on a lower front face of the left rear throttle body 32L), and positioned on the upstream side of the flow of fuel; and a downstream left rear injector 53*b*, which is arranged on the upper side of the left rear throttle body 32L (specifically, a position facing the left rear air funnel 35*c*), and positioned on the downstream side of the flow of fuel.

The right rear injector 54 includes: an upstream right rear injector 54*a*, which is arranged on the lower side of the right rear throttle body 32R (specifically, on a lower front face of the right rear throttle body 32R), and positioned on the upstream side of the flow of fuel; and a downstream right rear injector 54*b*, which is arranged on the upper side of the right rear throttle body 32R (specifically, a position facing the right rear air funnel 35*d*), and positioned on the downstream side of the flow of fuel.

Also referring to FIG. 6, the upstream left front injector 51*a*, the upstream right front injector 52*a*, the upstream left rear injector 53*a*, and the upstream right rear injector 54*a* are arranged in a center position in the vehicle width direction of the left front air funnel 35*a*, the right front air funnel 35*b*, the left rear air funnel 35*c*, and the right rear air funnel 35*d*, respectively.

Here, the upstream left front injector 51*a*, the upstream right front injector 52*a*, the upstream left rear injector 53*a*, and the upstream right rear injector 54*a* correspond to "upstream injector" in the scope of claims, while the downstream left front injector 51*b*, the downstream right front injector 52*b*, the downstream left rear injector 53*b*, and the downstream right rear injector 54*b* correspond to "downstream injector" in the scope of claims.

An upward rising bracket 55*a* is provided on an upper face in a right side part of the connection plate 38. The auxiliary machinery 55 is attached on a right side part of the bracket 55*a*.

<Piping>

The piping 60 includes: front first piping 61 attached to the left front injector 51 and the right front injector 52; front second piping 62 provided separately from the front first piping 61, and having an end part connected to the front first piping 61 so as to intersect with the front first piping 61; rear first piping 63 attached to the left rear injector 53 and the right rear injector 54; and rear second piping 64 provided separately from the rear first piping 63, and having an end part connected to the rear first piping 63 so as to intersect with the rear first piping 63.

In the embodiment, the front first piping and the rear first piping are collectively referred to as "first piping," and the front second piping and the rear second piping are collectively referred to as "second piping."

The front first piping 61 includes an upstream front first piping 61*a* connected to the upstream side of the front second piping 62, and downstream front first piping 61*b* connected to the downstream side of the front second piping 62.

The rear first piping 63 includes upstream rear first piping 63*a* connected to the upstream side of the rear second piping 64, and downstream rear first piping 63*b* connected to the downstream side of the rear second piping 64.

Here, the upstream front first piping and the upstream rear first piping correspond to "upstream first piping" in the scope of claims, while the downstream front first piping and the downstream rear first piping correspond to "downstream first piping" in the scope of claims.

The upstream front first piping 61*a* is attached to the upstream left front injector 51*a* and the upstream right front injector 52*a*. The upstream front first piping 61*a* extends in the vehicle width direction so as to straddle the upstream left front injector 51*a* and the upstream right front injector 52*a*.

The downstream front first piping 61*b* is attached to the downstream left front injector 51*b* and the downstream right front injector 52*b*. The downstream front first piping 61*b* extends in the vehicle width direction so as to straddle the downstream left front injector 51*b* and the downstream right front injector 52*b*. The downstream front first piping 61*b* has multiple (e.g., a total of four including those at the front and rear in the embodiment) first protrusions 61*c*, which are spaced apart in the vehicle width direction for the length of a later-mentioned first connection shaft 77*e*, and protrude frontward and rearward so as to form protrusions.

In the embodiment, the upstream left front injector 51*a* and the upstream right front injector 52*a* are provided in the upstream front first piping 61*a*, while the downstream left front injector 51*b* and the downstream right front injector 52*b* are provided in the downstream front first piping 61*b*.

The upstream rear first piping 63*a* is attached to the upstream left rear injector 53*a* and the upstream right rear injector 54*a*. The upstream rear first piping 63*a* extends in the vehicle width direction so as to straddle the upstream left rear injector 53*a* and the upstream right rear injector 54*a*.

The downstream rear first piping 63*b* is attached to the downstream left rear injector 53*b* and the downstream right rear injector 54*b*. The downstream rear first piping 63*b* extends in the vehicle width direction so as to straddle the downstream left rear injector 53*b* and the downstream right rear injector 54*b*. The downstream rear first piping 63*b* has multiple (e.g., a total of four including those at the front and rear in the embodiment) second protrusions 63*c*, which are spaced apart in the vehicle width direction for the length of a later-mentioned second connection shaft 78*e*, and protrude frontward and rearward so as to form protrusions.

In the embodiment, the upstream left rear injector 53*a* and the upstream right rear injector 54*a* are provided in the upstream rear first piping 63*a*, while the downstream left rear injector 53*b* and the downstream right rear injector 54*b* are provided in the downstream rear first piping 63*b*.

A fuel filter 65 for removing foreign matter and others from fuel pumped from an unillustrated fuel pump is provided, at the upstream end of the upstream front first piping 61*a*. The fuel pressurized by the fuel pump is supplied from the fuel tank 8. In left side view of FIG. 7, the fuel filter 65 extends obliquely, such that it is positioned closer to the rear toward the upper side. A cylindrical nozzle 65*a* is provided at the upstream end of the fuel filter 65. Fuel supply piping (none are shown) leading to the fuel pump is connected to the nozzle 65*a*.

Connection piping 66 for connecting the downstream end of the upstream front first piping 61*a* and the upstream end of the upstream rear first piping 63*a* is provided, between the upstream front first piping 61*a* and the upstream rear first piping 63*a*. In top view of FIG. 5, the connection piping 66 extends obliquely, such that it is positioned closer to the left toward the rear side from the downstream end of the upstream front first piping 61*a*, and reaches the upstream end of the upstream rear first piping 63*a*.

<Fuel Supply Path>

Hereinbelow, a supply path of fuel pumped from the fuel pump will be described. Note that in FIG. 5, arrows F indicate the flow of fuel.

The fuel pumped from the fuel pump is filtered through the fuel filter 65, and then flows into the upstream end of the upstream front first piping 61*a*. The fuel having flowed into the upstream end of the upstream front first piping 61*a* flows through the upstream front first piping 61*a*, and branches into the upstream left front injector 51*a* and the downstream side of the upstream front first piping 61*a*.

The fuel having branched to the upstream left front injector 51*a* is injected to the intake passage 31*a*, inside the left front throttle body 31L.

The fuel having branched into the downstream side of the upstream front first piping 61*a*, branches into the upstream right front injector 52*a*, the upstream end of the front second piping 62, and the upstream end of the connection piping 66.

The fuel having branched to the upstream right front injector 52*a* is injected to the intake passage 31*b*, inside the right front throttle body 31R.

The fuel having branched to the upstream end of the front second piping 62 flows through the front second piping 62, and flows into the upstream end of the downstream front first piping 61*b*. The fuel having flowed into the upstream end of the downstream front first piping 61*b* flows through the downstream front first piping 61*b*, and branches into the downstream right front injector 52*b* and the downstream side of the downstream front first piping 61*b*.

The fuel having branched to the downstream right front injector 52*b* is injected to the intake passage 31*b*, inside the right front throttle body 31R.

The fuel having branched to the downstream side of the downstream front first piping 61*b* flows through the downstream front first piping 61*b*, and flows into the downstream left front injector 51*b*. The fuel having flowed into the downstream left front injector 51*b* is injected to the intake passage 31*a*, inside the left front throttle body 31L.

The fuel having branched to the upstream side of the connection piping 66 flows through the connection piping 66, and branches into the upstream right rear injector 54*a* and the upstream end of the upstream rear first piping 63*a*.

The fuel having branched to the upstream right rear injector 54*a* is injected to the intake passage 32*b*, inside the right rear throttle body 32R.

The fuel having branched to the upstream end of the upstream rear first piping 63*a* flows through the upstream rear first piping 63*a*, and branches into the upstream left rear injector 53*a* and the upstream end of the rear second piping 64.

The fuel having branched to the upstream left rear injector 53*a* is injected to the intake passage 32*a*, inside the left rear throttle body 32L.

The fuel having branched to the upstream end of the rear second piping 64 flows through the rear second piping 64, and flows into the upstream end of the downstream rear first piping 63*b*. The fuel having flowed into the upstream end of the downstream rear first piping 63*b* flows through the downstream rear first piping 63*b*, and branches into the downstream left rear injector 53*b* and the downstream side of the downstream rear first piping 63*b*.

The fuel having branched to the downstream left rear injector 53*b* is injected to the intake passage 32*a*, inside the left rear throttle body 32L.

The fuel having branched to the downstream side of the downstream rear first piping 63*b* flows through the downstream rear first piping 63*b*, and flows into the downstream right rear injector 54*b*. The fuel having flowed into the downstream right rear injector 54*b* is injected to the intake passage 32*b*, inside the right rear throttle body 32R.

Thus, the fuel pumped from the fuel pump flows smoothly through the pipings 61 to 66. Then, the upstream and downstream left front injectors 51*a*, 51*b* inject fuel to the intake passage 31*a* inside the left front throttle body 31L, the upstream and downstream right front injectors 52*a*, 52*b* inject fuel to the intake passage 31*b* inside the right front throttle body 31R, the upstream and downstream left rear injectors 53*a*, 53*b* inject fuel to the intake passage 32*a* inside the left rear throttle body 32L, and the upstream and downstream right rear injectors 54*a*, 54*b* inject fuel to the intake passage 32*b* inside the right rear throttle body 32R. The gyro sensor 80 is arranged in a space surrounded by the fuel filter 65, the upstream front first piping 61*a*, the connection piping 66, and the upstream rear first piping 63*a*.

<Connection Part>

Also referring to FIGS. 7 and 8, a front connection member 71 includes an upstream front connection member 71*a* connecting the downstream end of the upstream front first piping 61*a* and the upstream end of the front second piping 62, and a downstream front connection member 71*b* connecting the upstream end of the downstream front first piping 61*b* and the downstream end of the front second piping 62.

A rear connection member 72 includes an upstream rear connection member 72*a* connecting the downstream end of the upstream rear first piping 63*a* and the upstream end of the rear second piping 64, and a downstream rear connection member 72*b* connecting the upstream end of the downstream rear first piping 63*b* and the downstream end of the rear second piping 64.

Here, the upstream front connection member and the upstream rear connection member correspond to "upstream connection part" in the scope of claims, while the downstream front connection member and the downstream rear connection member correspond to "downstream connection part" in the scope of claims.

In the embodiment, connection parts of the pipings 61 to 64 provided between end parts of the pipings 61 to 64, are collectively referred to as "connection member." A connection member 70 includes the front connection member 71 connecting the front first piping 61 and the front second piping 62, and the rear connection member 72 connecting the rear first piping 63 and the rear second piping 64.

The front connection member 71 and the rear connection member 72 have long adjustment holes 70*h*, which each extend so as to allow adjustment of the relative angle between the front first piping 61 and the front second piping 62, and the relative angle between the rear first piping 63 and the rear second piping 64. Hereinafter, the adjustment hole 70*h* in the rear connection member 72 will be described with reference to FIG. 9. Since the adjustment hole 70*h* in the front connection member 71 is the same as the adjustment hole 70*h* in the rear connection member 72, detailed description thereof will be omitted. Note that in FIG. 9, reference numeral 76 indicates a bolt (bolt for fixing the connection members 71, 72) inserted into the adjustment hole 70*h*.

Figure 9:
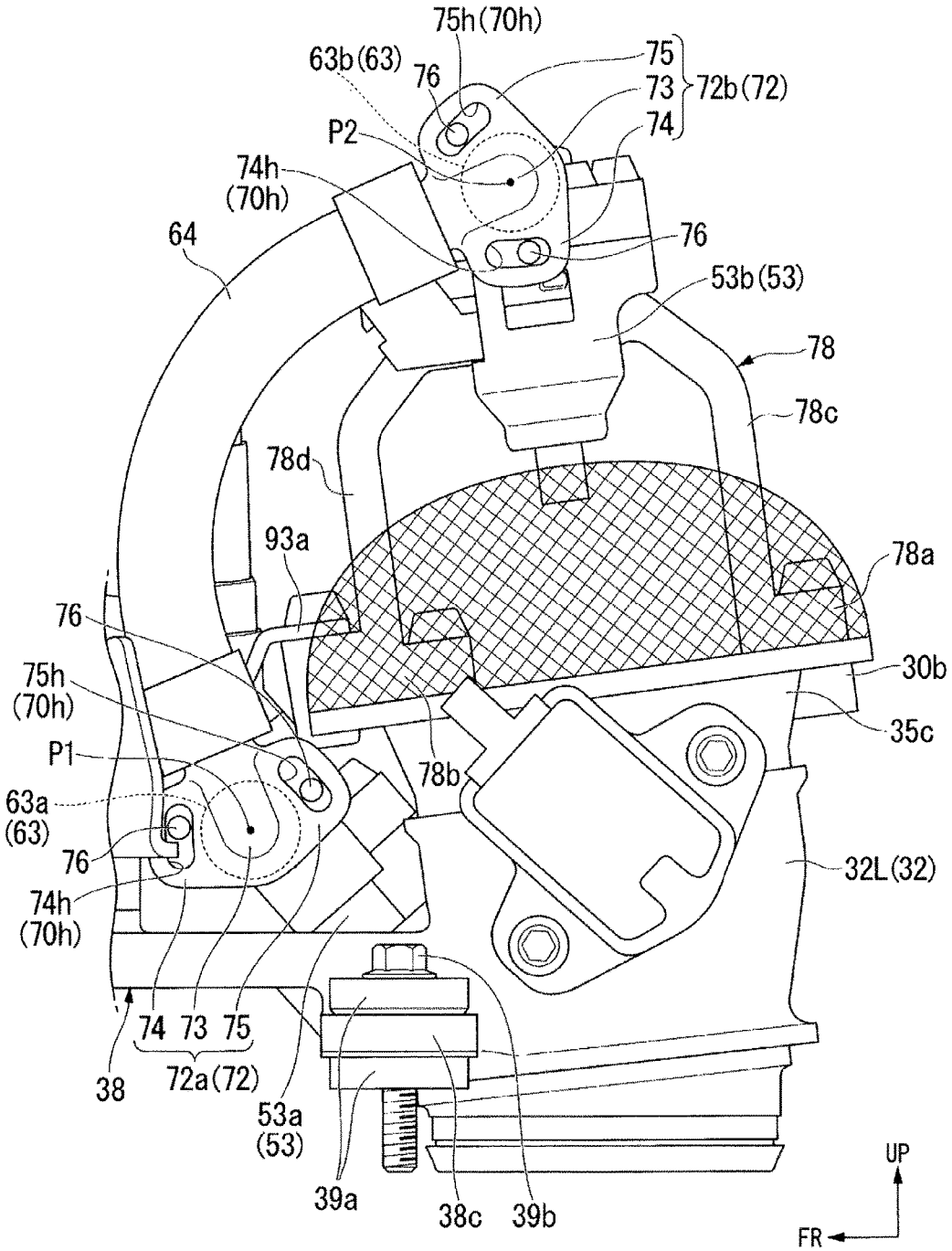
FIG. 9 is a left side view in which a main part of the aforementioned piping connection structure is enlarged.

Referring to FIG. 9, in left side view, the rear connection member 72 (the upstream rear connection member 72*a* and the downstream rear connection member 72*b*) includes a flow path forming portion 73, a first connection portion 74 provided on one side of the flow path forming portion 73, and a second connection portion 75 provided on the other side of the flow path forming portion 73 opposite to the first connection portion 74.

The flow path forming portion 73 of the upstream rear connection member 72*a* forms a flow path, which guides fuel from the upstream rear first piping 63*a* to the rear second piping 64.

The flow path forming portion 73 of the downstream rear connection member 72*b* forms a flow path, which guides fuel from the rear second piping 64 to the downstream rear first piping 63*b*.

The adjustment hole 70*h* is formed in both of the upstream rear connection member 72*a* and the downstream rear connection member 72*b*.

The adjustment hole 70*h* of the upstream rear connection member 72*a* is formed into an arc shape, along the annular outer periphery of the upstream rear first piping 63*a* in left side view. In FIG. 9, point P1 is the center of the upstream rear first piping 63*a*. The adjustment hole 70*h* of the upstream rear connection member 72*a*, is capable of adjusting the relative angle between the upstream rear first piping 63*a* and the rear second piping 64 around point P1, when viewed from the vehicle width direction.

The adjustment hole 70*h* of the downstream rear connection member 72*b* is formed into an arc shape, along the annular outer periphery of the downstream rear first piping 63*b* in left side view. In FIG. 9, point P2 is the center of the downstream rear first piping 63*b*. The adjustment hole 70*h* of the downstream rear connection member 72*b*, is capable of adjusting the relative angle between the downstream rear first piping 63*b* and the rear second piping 64 around point P2, when viewed from the vehicle width direction.

The adjustment hole 70*h* includes a first adjustment hole 74*h* formed in the first connection portion 74, and a second adjustment hole 75*h* formed in the second connection portion 75.

When viewed from the vehicle width direction, the first adjustment hole 74*h* and the second adjustment hole 75*h* in the upstream rear connection member 72*a*, are shifted closer to the upper side (upstream end side of the rear second piping 64) than point P1, and are formed into arc shapes based on point P1.

When viewed from the vehicle width direction, the first adjustment hole 74*h* and the second adjustment hole 75*h* in the downstream rear connection member 72*b* are shifted closer to the front side (downstream end side of the rear second piping 64) than point P2, and are formed into arc shapes based on point P2.

<Supporting Member>

Referring to FIGS. 4 to 6, supporting members 77, 78 for supporting the piping 60 are provided in the throttle body 30. The supporting members 77, 78 include the first supporting member 77 for supporting the downstream front first piping 61*b*, and the second supporting member 78 for supporting the downstream rear first piping 63*b*.

The first supporting member 77 includes: a front first base portion 77*a* fixed to the front connection portion 30*a*; a rear first base portion 77*b* fixed to the connection plate 38 behind the front first base portion 77*a*; a front first standing portion 77*c* standing up from the front first base portion 77*a*, and formed into a Y shape in front view of FIG. 6; a rear first standing portion 77*d* standing up from the rear first base portion 77*b*, and formed into a Y shape that overlaps with the front first standing portion 77*c* in front view of FIG. 6; and the first connection shaft 77*e* connecting left and right connection portions of the upper branch ends of the front first standing portion 77*c* and the upper branch ends of the rear first standing portion 77*d*, and formed into a bar extending in the vehicle width direction.

The second supporting member 78 includes: a rear second base portion 78*a* fixed to the rear connection portion 30*b*; a front second base portion 78*b* fixed to the connection plate 38 in front of the rear second base portion 78*a*; a rear second standing portion 78*c* standing up from the rear second base portion 78*a*, and formed into a Y shape in rear view; a front second standing portion 78*d* standing up from the front second base portion 78*b*, and formed into a Y shape that overlaps with the rear second standing portion 78*c* in rear view; and the second connection shaft 78*e* connecting left and right connection portions of the upper branch ends of the rear second standing portion 78*c* and the upper branch ends of the front second standing portion 78*d*, and formed into a bar extending in the vehicle width direction.

<Spacer>

Referring to FIGS. 4 and 6, a spacer 79 is provided between the piping 60 and the supporting members 77, 78 (first supporting member 77, second supporting member 78). The spacer 79 includes a first spacer 79*a* arranged between the downstream front first piping 61*b* and the first supporting member 77, and a second spacer 79*b* arranged between the downstream rear first piping 63*b* and the second supporting member 78.

The first spacer 79*a* is formed such that collars, which are sandwiched between the front and rear first protrusions 61*c* of the downstream front first piping 61*b*, and upper end parts of the front and rear first standing portions 77*c*, 77*d* of the first supporting member 77, are combined as one body. The first spacer 79*a* is thick in the vertical direction, and has substantially the same length as the longitudinal length of the front and rear first protrusions 61*c*, in top view of FIG. 5. Note that the first spacer 79*a* may be a separate collar.

The second spacer 79*b* is formed such that collars, which are sandwiched between the front and rear second protrusions 63*c* of the downstream rear first piping 63*b*, and upper end parts of the front and rear second standing portions 78*c*, 78*d* of the second supporting member 78, are combined as one body. The second spacer 79*b* has a smaller thickness in the vertical direction than the first spacer 79*a*, and has substantially the same length as the longitudinal length of the front and rear second protrusions 63*c*, in top view of FIG. 5. Note that the second spacer 79*b* may be a separate collar.

<Gyro Sensor>

Referring to FIG. 5, the gyro sensor 80 is positioned on the vehicle left-right centerline CL. To be specific, the gyro sensor 80 has a rectangular parallelepiped main body part, and is arranged such that the center of the main body part in the vehicle width direction overlaps with the vehicle left-right centerline CL in top view. This can reduce the influence of left and right tilting of the vehicle.

Figure 10:
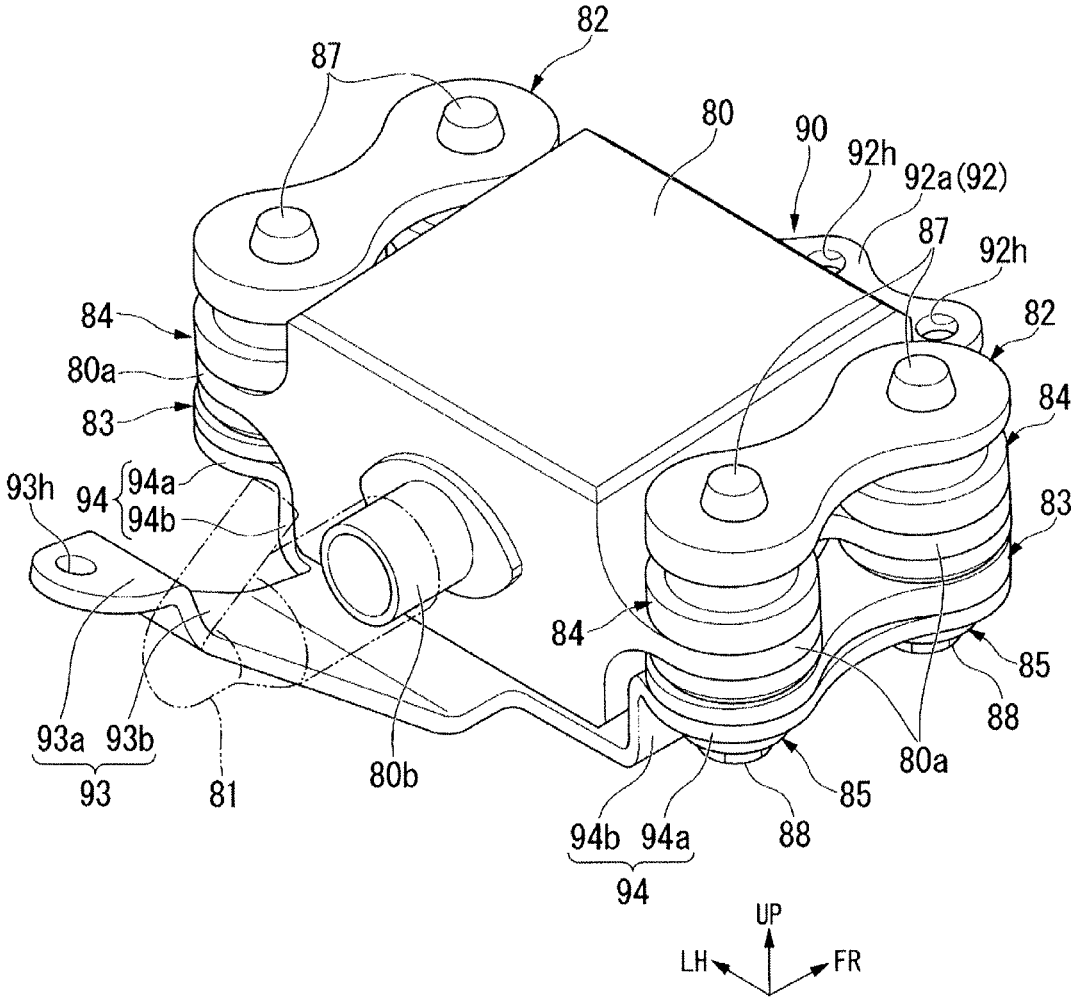
FIG. 10 is a perspective view of a supporting structure of a gyro sensor of the aforementioned motorcycle, as seen from the rear upper right direction.

Also referring to FIG. 10, an attachment flange 80*a* for attaching the gyro sensor 80 is formed in both left and right end parts of the gyro sensor 80. The attachment flanges 80*a* protrude to the left and right sides from both left and right side faces of the gyro sensor 80. Two each of the attachment flanges 80*a* are arranged on the left and right, so as to correspond to attachment parts (a front and rear pair on both left and right side faces of the gyro sensor 80) of the gyro sensor 80.

A wiring connection portion 80*b* for connecting wiring 81 that leads to an unillustrated control unit is formed, in a rear end part of the gyro sensor 80.

The gyro sensor 80 is fastened and fixed to a bracket 90 with bolts 87 and nuts 88 through grommets 84 (elastic members), with the grommets 84 attached to the left and right attachment flanges 80*a*, an upper correction plate 82 arranged above the attachment flanges, and a lower correction plate 83 arranged below the attachment flanges.

Figure 11:
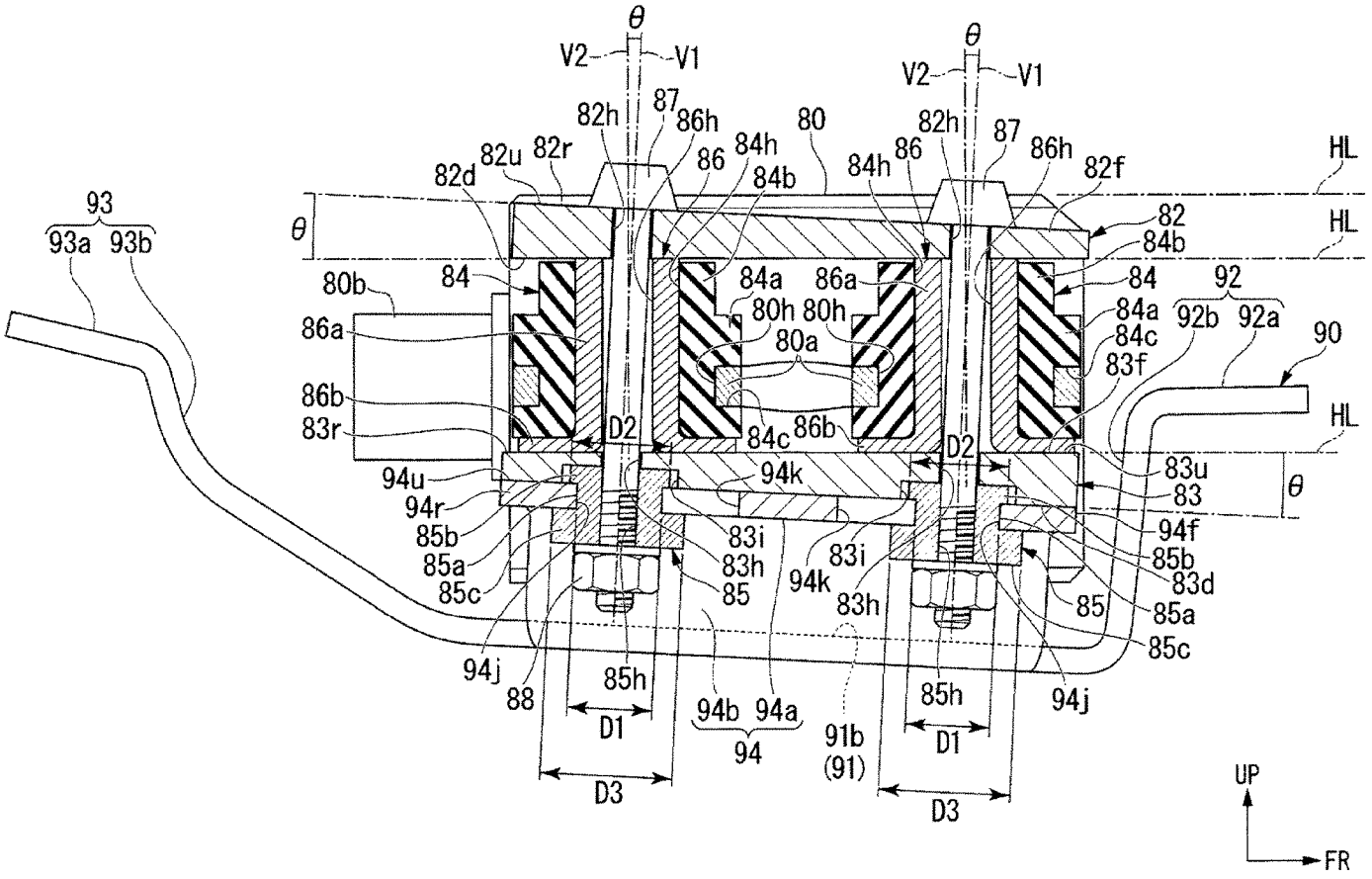
FIG. 11 is a right side view of the aforementioned supporting structure of the gyro sensor, including an XI-XI section of FIG. 5.

Also referring to FIG. 11, attachment holes 80*h*, which are opened in the vertical direction at positions corresponding to the attachment parts of the gyro sensor 80, are formed in the attachment flange 80*a*. The attachment hole 80*h* has a larger pore size than the outer diameter of a shaft part of the bolt 87.

<Bracket>

Referring to FIGS. 4 and 5, the bracket 90 supported to the throttle body 30 is provided, between the first supporting member 77 and the second supporting member 78. The bracket 90 is arranged so as to bridge the front throttle body 31 and the rear throttle body 32. The bracket 90 is formed into a longitudinally-extending shape connecting the rear first base portion 77*b* of the first supporting member 77, and the front second base portion 78*b* of the second supporting member 78. The gyro sensor 80 is arranged in a longitudinal center part of the bracket 90.

Figure 12:
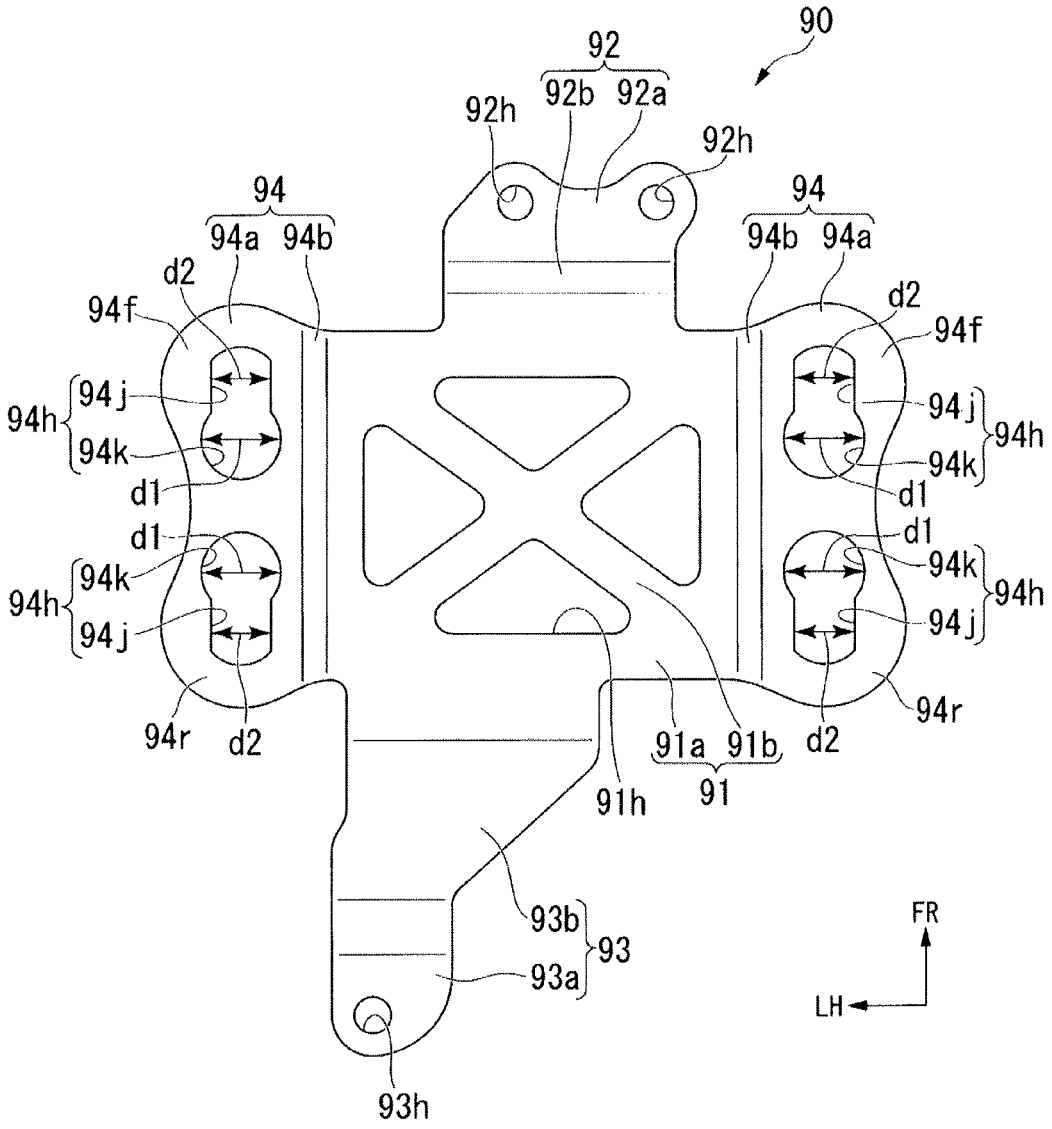
FIG. 12 is a top view of a bracket in which the aforementioned gyro sensor is arranged.

Also referring to FIGS. 11 and 12, the bracket 90 has a main body portion 91 facing a lower face of the gyro sensor 80, a front extension portion 92 provided on a front end part of the main body portion 91, a rear extension portion 93 provided on a rear end part of the main body portion 91, and left and right supporting portions 94 provided on left and right end parts of the main body portion 91.

The main body portion 91 has a rectangular frame-shaped frame portion 91*a*, and an X-shaped connection portion 91*b* in top view of FIG. 12. The main body portion 91 has an opening portion 91*h*, which is opened in the vertical direction and formed into a triangular shape having rounded corners, in top view of FIG. 12.

The front extension portion 92 includes a front connection portion 92*a* connected to the rear first base portion 77*b* of the first supporting member 77, and a front wall portion 92*b* bridging the rear end of the front connection portion 92*a* and the front end of the main body portion 91. In right side view of FIG. 11, the front wall portion 92*b* extends frontward from the front end of the main body portion 91, and then rises steeply toward the front upper direction to reach the rear end of the front connection portion 92*a*. The front connection portion 92*a* has paired left and right through holes 92*h*, which are opened in the thickness direction of the front connection portion 92*a*.

For example, the front connection portion 92*a* is fastened and fixed by inserting bolts into the through holes 92*h*, and screwing the bolts into nuts (not shown) provided in the rear first base portion 77*b*. Note that the front connection portion 92*a* may be fixed by welding, for example.

The rear extension portion 93 includes a rear connection portion 93*a* connected to the front second base portion 78*b* of the second supporting member 78, and a rear wall portion 93*b* bridging the front end of the rear connection portion 93*a* and the rear end of the main body portion 91. In right side view, the rear wall portion 93*b* extends rearward from the rear end of the main body portion 91, extends gradually toward the rear upper direction, and then rises steeply toward the rear upper direction to reach the front end of the rear connection portion 93*a*. The rear connection portion 93*a* has a through hole 93*h*, which is opened in the thickness direction of the rear connection portion 93*a*.

For example, the rear connection portion 93*a* is fastened and fixed by inserting a bolt into the through hole 93*h*, and screwing the bolt into a nut (not shown) provided in the front second base portion 78*b*. Note that the rear connection portion 93*a* may be fixed by welding, for example.

The left and right supporting portions 94 include: left and right collar supporting portions 94*a* formed into a plate that can support collars 85; and left and right wall portions 94*b* bridging inner ends in the vehicle width direction of the left and right collar supporting portions 94*a*, and outer ends in the vehicle width direction of the main body portion 91. The left and right wall portions 94*b* extend upward from left and right ends of the main body portion 91, and reach the inner ends in the vehicle width direction of the left and right collar supporting portions 94*a*.

The left and right collar supporting portions 94*a* have long holes 94*h*, which each includes: a large-diameter portion 94*k* opened in the thickness direction of the left and right collar supporting portions 94*a*, and having an inner diameter d1 larger than an outer diameter D2 of a later-mentioned upper flange portion 85*b* (flange portion); and a small-diameter portion 94*j* continuous with the large-diameter portion 94*k*, and having an inner diameter d2 larger than an outer diameter D1 of a later-mentioned tube portion 85*a* and smaller than the outer diameter D2. For example, the long hole 94*h* is a hook slot. This can prevent the collar 85 from falling off when the bolt 87 is detached.

Note that the inner diameter d1 of the large-diameter portion 94*k* may be the same as the outer diameter D2 of the upper flange portion 85*b*, and the inner diameter d2 of the small-diameter portion 94*j* may be the same as the outer diameter D1 of the tube portion 85*a*.

The long holes 94*h* are opened in positions where the small-diameter portions 94*j* are respectively aligned with the attachment holes 80*h*. The long holes 94*h* are arranged at the front and rear, such that the large-diameter portions 94*k* are positioned closer to the longitudinal center part of the left and right collar supporting portions 94*a*. This can make the left and right collar supporting portions 94*a* smaller than a case where the large-diameter portions 94*k* are positioned closer to front and rear end parts of the left and right collar supporting portions 94*a*. Hence, the left and right collar supporting portions 94*a* can be arranged favorably, in the space between the front throttle body 31 and the rear throttle body 32.

The left and right collar supporting portions 94*a* have a front supporting portion 94*f* in a position surrounding the small-diameter portion 94*j*, and a rear supporting portion 94*r* in a position behind the front supporting portion 94*r*. The front and rear supporting portions 94*f*, 94*r* have wide seating faces, on the outer side in the radial direction of the small-diameter portion 94*j* and on the outer side in the vehicle width direction, of longitudinal center parts of the left and right collar supporting portions 94*a*.

<Grommet>

The grommet 84 is formed into a cylindrical shape having a through hole 84*h*, which is opened in the vertical direction. The grommet 84 has a first tube portion 84*a*, and a second tube portion 84*b* having a smaller outer diameter than the outer diameter of the first tube portion 84*a*. An annular groove 84*c*, which is recessed radially inward from the outer peripheral surface of the first tube portion 84*a*, is formed on an outer peripheral part of the first tube portion 84*a*. An edge part surrounding the attachment hole 80*h* of the attachment flange 80*a* fits into the groove 84*c*. The grommet 84 protrudes to upper and lower sides from the attachment flange 80*a*, with the groove 84*c* fitted into the edge part.

A flanged collar 86 is inserted into the through hole 84*h* of the grommet 84. The flanged collar 86 includes: a shaft portion 86*a*, which is formed into a cylindrical shape having a through hole 86*h* opened in the vertical direction; and a flange portion 86*b*, which is formed into an annular shape protruding radially outward from a lower end part of the shaft portion 86*a*. The vertical length of the shaft portion 86*a* is slightly larger than the vertical length of the grommet 84. The flange portion 86*b* abuts on a lower end face of the first tube portion 84*a*, with the flanged collar 86 inserted into the through hole 84*h* of the grommet 84.

<Correction Plate>

The upper correction plate 82 is formed into a plate, which extends in the longitudinal direction and is tapered in cross-sectional view of FIG. 11. The upper correction plate 82 is a rigid member such as metal, and has a horizontal seating face 82*d* (lower face), and an inclined face 82*u* (upper face), which is inclined at an angle θ with respect to the seating face 82*d*. The upper correction plate 82 has through holes 82*h* opened in the vertical direction, in positions corresponding to the attachment holes 80*h*. The through hole 82*h* is formed perpendicular to the inclined face 82*u*, and has a pore size slightly larger than the outer diameter of the shaft part of the bolt 87. The upper correction plate 82 has a front seat portion 82*f* and a rear seat portion 82*r* thicker than the front seat portion 82*f*, in positions surrounding the through holes 82*h*. The front and rear seat portions 82*f*, 82*r* have wide seating faces, on the outer side in the vehicle width direction of a longitudinal center part of the upper correction plate 82.

The lower correction plate 83 is formed into a plate, which extends in the longitudinal direction, and is tapered in such a manner that the upper correction plate 82 is inverted in the longitudinal direction and the inclination direction is reversed in cross-sectional view of FIG. 11. The lower correction plate 83 is a rigid member such as metal, and has a horizontal seating face 83*u* (upper face), and an inclined face 83*d* (upper face), which is inclined at the angle θ with respect to the seating face 83*u*. The lower correction plate 83 has through holes 83*h* opened in the vertical direction, in positions corresponding to the attachment holes 80*h*. The through hole 83*h* is formed perpendicular to the inclined face 83*d*, and has a pore size slightly larger than the outer diameter of the shaft part of the bolt 87. The lower correction plate 83 has a front seat portion 83*f* and a rear seat portion 83*r* thinner than the front seat portion 83*f*, in positions surrounding the through holes 83*h*. The front and rear seat portions 83*f*, 83*r* have wide seating faces, on the outer side in the vehicle width direction of a longitudinal center part of the lower correction plate 83. Concave portions 83*i* depressed upward are formed in the inclined face 83*d* of the lower correction plate 83, in positions surrounding the through holes 83*h*.

Since the gyro sensor 80 is attached to a supporting face 94*u* through the upper and lower correction plates 82, 83, it is possible to correct the attachment angle of the gyro sensor 80 with respect to the supporting face 94*u* and maintain the horizontal state, even when the supporting face 94*u* is inclined for the angle θ with respect to a horizontal line HL.

Note that the inclination angle θ of the supporting face 94*u* is equivalent to an angle of change in longitudinal inclination of the vehicle body, which has changed due to adjustment in a front-wheel suspension device and a rear-wheel suspension device (none are shown), i.e., the difference between the inclination angle after adjustment, and the inclination angle in the normal state. In the embodiment, the vehicle body is inclined frontward for the angle θ.

<Collar>

The collar 85 includes: a cylindrical tube portion 85*a* having a through hole 85*h* opened in the vertical direction; the annular upper flange portion 85*b* protruding radially outward from an upper end part of the tube portion 85*a*, and having the outer diameter D2 larger than the outer diameter D1 of the tube portion 85*a*; and a lower flange portion 85*c* protruding radially outward from a lower end part of the tube portion 85*a*, and having an outer diameter D3 larger than the outer diameter D2 of the upper flange portion 85*b*.

Of the collars 85, the upper flange portions 85*b* and the tube portions 85*a* are inserted into the large-diameter portions 94*k* of the left and right collar supporting portions 94*a*, and are slid toward the small-diameter portions 94*j*. Thus, the collars 85 are supported to the front and rear supporting portions 94*f*, 94*r* of the left and right collar supporting portions 94*a*, with the tube portions 85*a* inserted into the small-diameter portions 94*j* of the left and right collar supporting portions 94*a*, and the upper and lower flange portions 85*b*, 85*c* arranged such that they sandwich the small-diameter portions 94*j* from upper and lower sides. Note that the vertical gap between the upper flange portion 85*b* and the lower flange portion 85*c* is substantially the same size as the thickness of the left and right collar supporting portions 94*a*.

<Attachment of Gyro Sensor>

Hereinafter, a description will be given of an example of how to attach the gyro sensor 80.

First, the inclined face 83*d* of the lower correction plate 83 is placed on the supporting faces 94*u* (upper face) of the left and right collar supporting portions 94*a*, such that the upper flange portions 85*b* are accommodated inside the concave portions 83*i*, with the collars 85 supported to the front and rear supporting portions 94*f*, 94*r* of the left and right collar supporting portions 94*a*, and the through holes 83*h* in the lower correction plate 83 are aligned with the through holes 85*h* in the collars 85. Note that the depth of the concave portion 83*i* is substantially the same as the thickness of the upper flange portion 85*b*.

Of the lower correction plate 83, the inclined face 83*d* is inclined upward toward the rear for the angle θ, with respect to the seating face 83*u*, and therefore the seating face 83*u* is parallel to the horizontal line HL. At this time, since the through holes 83*h* in the lower correction plate 83 are formed perpendicular to the inclined face 83*d*, the axes of the through holes 83*h* overlap with axes V1 of the through holes 85*h* in the collars 85, and the through holes 83*h* become continuous with the through holes 85*h* on the same axis. Note that the axis V1 is perpendicular to the supporting face 94*u*, and therefore is inclined for the angle θ with respect to a vertical line V2.

Next, the lower ends of the flange portions 86*b* of the flanged collars 86 are placed on the seating face 83*u* of the lower correction plate 83, with the grommets 84 and the flanged collars 86 attached to the attachment flanges 80*a* of the gyro sensor 80, and the through holes 86*h* in the flanged collars 86 are aligned with the through holes 83*h* in the lower correction plate 83. At this time, since the seating face 83*u* of the lower correction plate 83 is parallel to the horizontal line HL, the flange portions 86*b* and the attachment flanges 80*a* are also parallel to the horizontal line HL. Note that the axes of the grommets 84 and flanged collars 86 coincide with the vertical line V2.

Next, the seating face 82*d* of the upper correction plate 82 is placed on the upper end of the shaft portions 86*a* of the flanged collars 86, and the through holes 82*h* in the upper correction plate 82 are aligned with the through holes 86*h* in the flanged collars 86. At this time, since the through holes 82*h* in the upper correction plate 82 are formed perpendicular to the inclined face 82*u*, the axes of the through holes 82*h* overlap with the axes V1.

In this state, the shaft parts of the bolts 87 are inserted into the through holes 82*h* in the upper correction plate 82, the through holes 86*h* in the flanged collars 86, the through holes 83*h* in the lower correction plates 83, and the through holes 85*h* in the collars 85, and then screw parts protruding downward from the lower flange portions 85*c* of the collars 85 are fastened and fixed to the nuts 88. Thus, the gyro sensor 80 is supported to the bracket 90. Note that the screw part of the bolt 87 may be fastened and fixed to the collar 85, by providing an internal thread in the collar 85.

As has been described, the above embodiment is a piping connection structure of the vehicle 1 including: the throttle body 30 connected to the power unit 10 of the vehicle 1 to adjust the intake air amount; the fuel injection device 50 for injecting fuel to the intake passage including the throttle body 30; the first pipings 61, 63 attached to the fuel injection device 50; and the second pipings 62, 64 provided separately from the first pipings 61, 63, and having end parts connected to the first pipings 61, 63 so as to intersect with the first pipings 61, 63, in which the connection member 70 between the first pipings 61, 63 and the second pipings 62, 64 has long adjustment holes 70*h*, which extend so as to allow adjustment of the relative angles between the first pipings 61, 63 and the second pipings 62, 64.

According to this configuration, the connection member 70 between the first pipings 61, 63 and the second pipings 62, 64 has the long adjustment holes 70*h*, which extend so as to allow adjustment of the relative angles between the first pipings 61, 63 and the second pipings 62, 64. Hence, by rotating the connection member 70 along the long hole shape of the adjustment holes 70*h*, the relative angles (angles at which the second pipings 62, 64 are attached to the first pipings 61, 63) can be adjusted with the second pipings 62, 64 having substantially the same looseness. For this reason, common second pipings 62, 64 can be set, even when the height of the fuel injection device 50 is set for each model. Accordingly, versatility of the second pipings 62, 64 can be improved. Additionally, since versatility of the second pipings 62, 64 is improved, cost can be reduced by mass production.

Also, in the above embodiment, the adjustment hole 70*h* includes the first adjustment hole 74*h* formed in the first connection portion 74, and the second adjustment hole 75*h* formed in the second connection portion 75. Since the first adjustment hole 74*h* and the second adjustment hole 75*h* are provided so as to sandwich the flow path forming portion 73, the second pipings 62, 64 can be attached more stably to the first pipings 61, 63, as compared to a case where only a single adjustment hole is provided. Additionally, fine adjustment of the relative angle is facilitated.

Also, in the above embodiment, the adjustment holes 70*h* are formed into arc shapes, along the outer periphery of the first pipings 61, 63 when viewed from the vehicle width direction. Since the relative angle can be adjusted with the first pipings 61, 63 and the second pipings 62, 64 joined temporarily, it is easier to attach the second pipings 62, 64 to the first pipings 61, 63 and work time can be reduced, as compared to a case where multiple round holes are arranged at predetermined intervals, along the outer periphery of the first piping 61, 63 when viewed from the vehicle width direction. Additionally, fine adjustment of the relative angle is facilitated.

Also, in the above embodiment, the spacer 79 is provided between the first pipings 61, 63 and the supporting members 77, 78. Hence, the height of the first pipings 61, 63 can be adjusted by adjusting the height of the spacer 79. Therefore, common first pipings 61, 63 can be set, even when the capacity of the fuel injection device 50 is varied. Accordingly, versatility of the first pipings 61, 63 can be improved. Additionally, since versatility of the first pipings 61, 63 is improved, cost can be reduced by mass production.

Also, in the above embodiment, the adjustment holes 70*h* are formed in both of the upstream connection members 71*a*, 72*a*, and the downstream connection members 71*b*, 72*b*. Hence, the second pipings 62, 64 can be used by inverting the upstream and downstream sides thereof. Accordingly, versatility of the second pipings 62, 64 can be improved.

Additionally, since versatility of the second pipings 62, 64 is improved, cost can be reduced by mass production.

Also, in the above embodiment, the upstream injectors 51*a* to 54*a* are provided in the upstream first pipings 61, 63*a*, while the downstream injectors 51*b* to 54*b* are provided in the downstream first pipings 61*b*, 63*b*. Hence, common first pipings 61*a*, 61*b*, 63*a*, 63*b* can be used even when the upstream injectors 51*a* to 54*a* and the downstream injectors 51*b* to 54*b* are varied, and versatility of the second pipings 62, 64 can be improved. Therefore, cost can be reduced by mass production.

Note that the present invention is not limited to the above embodiment, and, for example, the straddle type vehicle includes general vehicles that a rider rides by straddling the vehicle body, and includes not only a motorcycle (including a motorized bicycle and a scooter type vehicle), but also three-wheeled vehicles (including vehicles two-wheeled at the front and one-wheeled at the rear, in addition to those one-wheeled at the front and two-wheeled at the rear).

The configuration of the above embodiment is one example of the present invention, and various changes, such as replacing a component of the embodiment with a known component, can be made without departing from the gist of the invention.

What is claimed is:

1. A piping connection structure of a vehicle comprising:

a throttle body connected to a power unit of the vehicle to adjust an intake air amount;

a fuel injection device for injecting fuel to an intake passage including said throttle body;

first piping attached to said fuel injection device; and second piping provided separately from said first piping, and having an end part connected to said first piping so as to intersect with said first piping, wherein a connection part between said first piping and said second piping has a long adjustment hole, which extends so as to allow adjustment of a relative angle between said first piping and said second piping;

said connection part includes a flow path forming portion forming a flow path that guides fuel from said second piping to said first piping, a first connection part provided on one side of said flow path forming portion, and a second connection part provided on the other side of said flow path forming portion opposite to said first connection part;

said adjustment hole includes a first adjustment hole formed in said first connection part, and a second adjustment hole formed in said second connection part, when viewed from a vehicle width direction, in said first connection part and said second connection part, said first adjustment hole and said second adjustment hole are shifted closer to a side in which said second piping is connected to said connection part with respect to a center of said first piping, said fuel injection device includes a first injector and a second injector;

said first injector and said second injector are arranged side by side in the vehicle width direction;

said first piping extends in the vehicle width direction, so as to straddle said first injector and said second injector;

a supporting member having branch ends and supporting said first piping with said branch end is provided in said throttle body; and spacers are provided between said branch ends of said supporting member and said first piping.

2. The piping connection structure according to claim 1, wherein:

said adjustment hole is formed into an arc shape, along the outer periphery of said first piping in side view.

3. The piping connection structure according to claim 1, wherein:

said first piping includes upstream first piping connected to the upstream side of said second piping, and downstream first piping connected to the downstream side of said second piping;

said connection part includes an upstream connection part connecting said upstream first piping and the upstream side of said second piping, and a downstream connection part connecting said downstream first piping and the downstream side of said second piping; and said adjustment hole is formed in both of said upstream connection part and said downstream connection part.

4. The piping connection structure according to claim 3, wherein:

said fuel injection device includes a first injector and a second injector;

said first injector and said second injector each includes an upstream injector and a downstream injector;

said upstream injector is provided in said upstream first piping; and said downstream injector is provided in said downstream first piping.

* * * * *